US009714122B2

(12) United States Patent
Snape

(10) Patent No.: US 9,714,122 B2
(45) Date of Patent: Jul. 25, 2017

(54) DISCHARGE APPARATUS

(71) Applicant: Process Link Limited, Warwickshire (GB)

(72) Inventor: George William Snape, Shipston-on-Stour (GB)

(73) Assignee: PROCESS LINK LIMITED, Shipston-on-Stour, Warwickshire (GB)

( * ) Notice: Subject to any disclaimer, the term of this patent is extended or adjusted under 35 U.S.C. 154(b) by 394 days.

(21) Appl. No.: 14/360,167

(22) PCT Filed: Nov. 21, 2012

(86) PCT No.: PCT/GB2012/052880

§ 371 (c)(1),
(2) Date: May 22, 2014

(87) PCT Pub. No.: WO2013/076482

PCT Pub. Date: May 30, 2013

(65) Prior Publication Data

US 2014/0326751 A1 Nov. 6, 2014

(30) Foreign Application Priority Data

Nov. 22, 2011 (GB) ..... 1120153.0
Nov. 29, 2011 (GB) ..... 1120590.3
Aug. 16, 2012 (GB) ..... 1214641.1

(51) Int. Cl.
*B65D 35/56* (2006.01)
*B65D 47/06* (2006.01)
(Continued)

(52) U.S. Cl.
CPC ..... *B65D 47/063* (2013.01); *B65B 37/04* (2013.01); *B65B 69/0083* (2013.01);
(Continued)

(58) Field of Classification Search
CPC ..... B56D 47/063; B56B 69/0075; B56B 69/0083; B56B 69/0091; B65D 47/063;
(Continued)

(56) References Cited

U.S. PATENT DOCUMENTS 3,854,612 A * 12/1974 Snape ..... B65D 88/66 222/196
4,810,156 A * 3/1989 Pendleton ..... B65B 69/0091 222/203
(Continued)

FOREIGN PATENT DOCUMENTS

CA 2131132 3/1996
DE 197 07 581 10/1998
(Continued)

OTHER PUBLICATIONS

Great Britain Search Report dated Feb. 7, 2013 issued in Great Britain Patent Application No. 1214641.1, 4 pp.
(Continued)

*Primary Examiner* — Lien Ngo
(74) *Attorney, Agent, or Firm* — Nixon & Vanderhye P.C.

(57) ABSTRACT

A discharge device for use with a bulk container of the kind having an outlet through which product is to be dispensed. The device has an inlet end, an outlet end and a wall extending between said inlet end and said outlet end. The device is configured for directing a flow of product from an outlet of a bulk container, and is further configured to permit relative movement between said inlet end and said outlet end between a retracted position and an extended position. The outlet end may take the form of a plate for supporting the lower end of the bulk container. The plate may be vibrated for assisting discharge of product from the bulk container.

19 Claims, 18 Drawing Sheets

(51) Int. Cl.

| | |
|---|---|
| ***B65B 37/04*** | (2006.01) |
| ***B65B 69/00*** | (2006.01) |
| ***B65D 88/16*** | (2006.01) |
| ***B65D 88/66*** | (2006.01) |
| ***B65D 90/20*** | (2006.01) |
| ***B65D 61/00*** | (2006.01) |
| *B65B 57/14* | (2006.01) |

(52) U.S. Cl.
CPC ..... *B65D 61/00* (2013.01); *B65D 88/1681* (2013.01); *B65D 88/66* (2013.01); *B65D 90/205* (2013.01); *B65B 57/145* (2013.01)

(58) Field of Classification Search
CPC .. B65D 88/1681; B65D 88/66; B65D 90/205; B65D 61/00; B65B 69/0075; B65B 69/0083; B65B 69/0091; B65B 37/04; B65B 57/145
USPC ..... 222/105, 181.1–181.3, 185.1; 414/403–405, 412, 414, 415, 422
See application file for complete search history.

(56) References Cited

U.S. PATENT DOCUMENTS

| | | | | |
|---|---|---|---|---|
| 5,141,135 | A | 8/1992 | Volk, Jr. | |
| 5,947,333 | A * | 9/1999 | Hoffmann | B65B 69/0091 222/105 |
| 6,186,360 | B1 * | 2/2001 | Becker | B65B 69/0091 222/1 |
| 7,159,744 | B2 * | 1/2007 | Sterner | B65B 69/0083 222/196 |
| 7,223,058 | B2 * | 5/2007 | Nyhof | B65B 69/0091 414/415 |
| 7,287,946 | B2 * | 10/2007 | Bonerb | B65B 69/0091 414/403 |
| 2006/0151525 | A1 | 7/2006 | Wahl | |
| 2008/0014032 | A1 | 1/2008 | Rillmann | |
| 2008/0187423 | A1 | 8/2008 | Mauchle et al. | |
| 2009/0008410 | A1 * | 1/2009 | Kosich | B65D 88/1668 222/105 |

FOREIGN PATENT DOCUMENTS

| | | | | |
|---|---|---|---|---|
| DE | 19740437 | C1 * | 12/1998 | B65B 69/0091 |
| DE | 10013838 | A1 * | 10/2001 | B65B 69/0091 |
| EP | 0 073 349 | | 3/1983 | |
| GB | 1 289 623 | | 9/1972 | |
| GB | 2 150 538 | | 7/1985 | |
| GB | 2 439 945 | | 1/2008 | |

OTHER PUBLICATIONS

Great Britain Search Report dated Jun. 18, 2013 issued in Great Britain Patent Application No. 1214641.1, 2 pp.
International Search Report dated Feb. 20, 2013 issued in PCT International Application No. PCT/GB2012/052880, 3 pp.

* cited by examiner

DISCHARGE APPARATUS

This application is the U.S. national phase of International Application No. PCT/GB2012/052880 filed 21 Nov. 2012 which designated the U.S. and claims priority to Great Britain Patent Application No. 1120153.0 filed 22 Nov. 2011, Great Britain Patent Application No. 1120590.3 filed 29 Nov. 2011 and Great Britain Patent Application No. 1214641.1 filed 16 Aug. 2012, the entire contents of each of which are hereby incorporated by reference.

TECHNICAL FIELD

The present invention relates to discharge apparatus, more particularly, but not exclusively, to a discharge device for use in discharging product from a bulk container, e.g. a flexible intermediate bulk container. The present invention further relates to a discharge assembly for bulk containers.

BACKGROUND

A flexible intermediate bulk container (FIBC), sometimes called a "big bag" or "bulk bag", is a known term of art for a flexible container of the kind commonly used for transporting bulk quantities of loose, powdered or granular product, such as plastics, minerals, chemicals, agricultural products or foodstuffs. An example of an FIBC is indicated generally at 10 in FIGS. 1 and 2. The FIBC has a main body 16 in which product is stored and an outlet channel 18 leading to an opening 12 through which product can be discharged.

To dispense product from the FIBC, the FIBC is often held on a frame or other support, with a valve arranged in communication with an outlet opening of the FIBC, so that the product can be selectively released from the FIBC. In some examples, a discharge device in the form of a rigid cone is used to funnel the flow of product from the outlet of the FIBC.

SUMMARY OF INVENTION

The present invention seeks to overcome or mitigate one or more problems associated with conventional discharge devices, particularly, but not exclusively, discharge devices used for dispensing product from an FIBC.

A first aspect of the invention provides a discharge apparatus for use with a bulk container of the kind having an outlet through which product is to be dispensed, the discharge apparatus comprising: an inlet end, an outlet end, and a wall extending between said inlet end and said outlet end, wherein said inlet end is configured for receiving the lower end of a bulk container, said outlet end is configured for directing a flow of product from a bulk container received in the inlet end, and further wherein the apparatus is configured to allow relative movement between said inlet end and said outlet end to alter the distance between said inlet end and said outlet end.

The ability to permit relative movement between the inlet end and the outlet end has multiple advantages. For example, the inlet end can be moved from a retracted state to an extended state during a discharge operation, in order to agitate the bulk container as the volume of product in the bulk container decreases. This can alleviate the need for manual intervention to discharge product trapped within the bulk container.

The discharge apparatus is particularly suited for use with flexible or otherwise deformable bulk containers, such as flexible intermediate bulk containers or the like.

The wall extending between the inlet end and the outlet end is flexible, so as to be able to change shape to accommodate for the relative movement between the inlet end and the outlet end. In exemplary embodiments, the wall consists of a flexible fabric material (e.g. the same as or similar to the material used to construct a conventional FIBC). In alternative embodiments, at least a portion of the wall may comprise a concertina-type construction.

In the extended state, the inlet and outlet ends are spaced from each other. In the retracted state (e.g. collapsed state) the spacing between the inlet and outlet ends is reduced. In some embodiments, the inlet end is aligned or in near alignment with the outlet end, in the retracted state.

In exemplary embodiments, the discharge apparatus is configured to change configuration from a retracted state to an extended state dependent upon the weight of product in the bulk container, e.g. so that the inlet end moves away from the outlet end as product is discharged from the container.

In exemplary embodiments, the discharge apparatus is configured to support an outlet end of a bulk container and to collapse from an extended state to a retracted state dependent upon the weight of product in the bulk container, e.g. upon loading of a bulk container into the apparatus.

The wall may define a cone in the extended state. A cone advantageously directs the product flow, providing a controlled discharge.

The inlet and outlet ends may comprise concentric frame members. The inlet frame member and the outlet frame member may be substantially the same shape. In exemplary embodiments, the inlet frame member and/or the outlet frame member defines an annulus, e.g. having a continuous periphery.

In exemplary embodiments, the inlet frame member and/or the outlet frame member is circular. In other embodiments, the inlet frame member and/or the outlet frame member may define a square, rectangular or other polygonal shape.

In exemplary embodiments, the relative diameter of the frame members may be selected to define a desired cone angle in the extended state.

The discharge apparatus may comprise an arrangement for moving the inlet end towards the bulk container during a discharge operation. For example, the inlet end may be configured to raise during a discharge operation, e.g. under the action of a spring or cylinder. The cylinder may be sprung, hydraulic or pneumatic. In embodiments where a cylinder is used, a wheel and runner mechanism may be used to guide extension of the cylinder so that the cylinders stay nominally in line to avoid problems when lifting a variable or out-of-balance load.

In exemplary embodiments, said arrangement may include a biasing element, e.g. such as a spring or the like, which is configured to extend or retract dependent on the weight acting against it. In an example, the arrangement includes a roller spring arranged to change state from a retracted position to an extended position, dependent upon a weight acting on the apparatus during handling of a bulk container.

The biasing element may be permanently or detachably connected to the inlet end of the discharge apparatus.

In exemplary embodiments, the discharge apparatus includes a plurality of biasing elements acting in the same direction on the inlet end (e.g. four equally spaced spring elements or cylinders).

In exemplary embodiments, the discharge apparatus includes a valve for communication with the outlet of the bulk container. The valve can be operated between open and closed states for selectively discharging product from a bulk container via the discharge apparatus.

Typically, the outlet of bulk the container will comprise a conduit through which product flows during discharge. In exemplary embodiments, the valve is arranged below the outlet end of the discharge apparatus, such that the outlet conduit of a bulk container must pass through the inlet and outlet ends of the discharge apparatus for connection to the valve.

The discharge apparatus may be configured to permit relative movement between the outlet end and the valve, e.g. for agitating any portion of a bulk container extending between the outlet end and the valve. Advantageously, this arrangement enables full discharge of the bulk container so that it is nominally empty, which further alleviates the need for manual intervention to discharge the container. Typically, this may involve stretching out the outlet conduit of the container (e.g. by increasing the distance between the outlet end and the valve), thereby causing material held within the outlet conduit to be dislodged.

The inlet and outlet ends may be supported on a frame. The frame may be configured for suspending a bulk container above the outlet end. In exemplary embodiments, the bulk container may be suspended from sides of the frame or from a crossbar extending between sides of the frame, e.g. via an attachment on the sides of the frame or on a cross bar extending between the sides of the frame.

The frame may be provided in two detachable parts. For example, the frame may have an upper end from which a bulk container may be suspended (e.g. movement therewith, using a fork lift) and a lower end on which the inlet and outlet ends may be supported. The biasing elements may also be attached to or supported on the lower frame. For example, the biasing elements may be attached to the frame or positioned within the frame structure (e.g. the frame may be made from hollow bar and the biasing element may be housed therein).

The upper end of the frame may be movable relative to the lower end of the frame, for lifting an upper end of a bulk container away from the outlet end of the discharge apparatus. This enables slack in the walls of the container to be accounted for during discharge from the container, reducing the likelihood of product becoming trapped by the side walls of the container.

The discharge apparatus may include a container wall for fully or partially surrounding or supporting an outer wall or the sides of the bulk container. The container wall provides security for the bulk container. The container wall may be made from a flexible material. The container wall may be releasably connected to the frame. The releasable connection of the container to the frame permits ease of access when removing and reattaching a bulk container to the frame. For example the container wall may be made from a flexible material and the container wall may be connected to the frame via loops, that may be formed on the container wall.

The discharge apparatus may comprise a support plate for supporting the lower end of a bulk container. The support plate may include an outlet region through which the outlet of a bulk container may extend when supported on the support plate. The discharge apparatus may comprise a vibration unit for vibrating said support plate, e.g. for selectively vibrating said support plate. In exemplary embodiments, the support plate comprises the outlet end of the apparatus.

The discharge apparatus may include a vibration applicator arranged for applying vibration to the inlet end and/or the outlet end for facilitating discharge of the contents of a bulk container in communication with the discharge apparatus.

In exemplary embodiments, the lower end of the bulk container is loaded onto and supported by the support plate, with the outlet of the container arranged to extend through the outlet region of the support plate. Typically, this means that the bulk container is arranged with its outlet lowermost, so that product may flow through the outlet under gravity. Vibration of the support plate has the effect of undermining any consolidation of the product stored in the container, greatly assisting in encouraging the product to flow towards the outlet of the container.

Other features of the first aspect are set forth in the appended claims.

A second aspect of the invention provides a discharge apparatus for use with a bulk container of the kind having an outlet through which product is to be dispensed, the discharge apparatus comprising: a support plate for supporting a bulk container, the support plate including an outlet region through which the outlet of a bulk container may extend when supported on the support plate; and a vibration unit for selectively vibrating said support plate.

In use, the lower end of the bulk container is loaded onto and supported by the support plate, with the outlet of the container arranged to extend through the outlet region of the support plate. Typically, this means that the bulk container is arranged with its outlet lowermost, so that product may flow through the outlet under gravity. Vibration of the support plate has the effect of undermining any consolidation of the product stored in the container, greatly assisting in encouraging the product to flow towards the outlet of the container.

The support plate may be a flat plate having an aperture which defines the outlet region. When the bulk container is a flexible bulk container or otherwise comprises a flexible portion at the lower end of the container, the use of a flat plate permits the container to have and maintain a generally flat-bottomed shape during discharge, and eliminates the risk of the lower sides of the bulk container collapsing inwards and inhibiting smooth flow of product within the bulk container towards the outlet.

In exemplary embodiments, the support plate has a diameter or area greater than the diameter or area of the end of the container intended to be supported on the plate. This ensures that the end of the container is fully supported on the plate.

The discharge apparatus may comprise a detector (e.g. an optical detector) for detecting product flow and an actuator for selectively actuating the vibration unit in response to a signal from the detector. The detector allows for automatic vibration of the support plate if a problem arises during discharge, e.g. if the product is not flowing freely through the outlet of the container.

The discharge apparatus may comprise a frame for supporting the support plate. The upper end of the bulk container may be attached to the frame, and the frame may be configured for raising the upper end of the container relative to the support plate. For example, the frame may comprise two parts: an upper part for connection of the upper end of a bulk container and a discharge part which includes the support plate. The upper part may be movable relative to the discharge part, for lifting the upper end of the bulk container away from the support plate. This enables slack in the walls of the container to be accounted for during discharge from the container, reducing the likelihood of product becoming trapped by the side walls of the container.

In exemplary embodiments, one or more cylinders are provided for driving the upper part of the frame relative to the discharge part.

In exemplary embodiments, the support plate forms part of a discharge device of the kind having an inlet end (e.g. an annulus into which the lower end of a bulk container may be positioned), an outlet end (e.g. said support plate), and a wall extending between said inlet end and said outlet end, wherein the lower end of the bulk container is intended to be arranged inside the inlet end, said outlet end is configured for directing a flow of product from said bulk container, and further wherein the apparatus is configured to provide relative movement between said inlet end and said outlet end, and thereby alter the distance between said inlet end and said outlet end.

The ability to permit relative movement between the inlet end and the outlet end has multiple advantages. For example, the inlet end can be moved from a retracted state to an extended state during a discharge operation, in order to agitate the bulk container as the volume of product in the bulk container decreases. This can alleviate the need for manual intervention to discharge product trapped within the bulk container.

In exemplary embodiments, the apparatus includes an arrangement for moving the inlet end relative to the outlet end. In exemplary embodiments, the arrangement is configured to raise the position of the inlet end relative to said outlet end.

In exemplary embodiments, the wall between said inlet end and said outlet end is of flexible construction, e.g. a flexible fabric material.

In exemplary embodiments, the discharge device is configured to change configuration of the inlet end from a retracted state to an extended state, e.g. dependent upon the weight of product in the bulk container. Exemplary embodiments, the comprise one or more cylinders for driving the inlet end away from the outlet end.

In exemplary embodiments, the device is operable between a first state in which the inlet and outlet ends are arranged at a first spacing, and a second state in which the inlet and outlet ends are arranged at a second spacing, greater than said first spacing, and wherein the wall defines a cone in the second state.

Exemplary embodiments include a valve for communication with the outlet of a bulk container and operable between open and closed states for selectively discharging product from the bulk container. In exemplary embodiments, the valve is arranged beneath said outlet end, and the apparatus is configured to permit relative movement between said outlet end and the valve.

In exemplary embodiments, the apparatus comprises a container wall arranged supporting an outer or side wall of a bulk container arranged in communication with the outlet end of the apparatus.

The discharge apparatus of the second aspect may comprise any combination of features of the first aspect.

A third aspect of the invention provides a discharge assembly comprising: a bulk container having an outlet through which product is to be dispensed; and a discharge apparatus according to the first or second aspect of the invention.

A fourth aspect of the invention provides a discharge assembly comprising: a bulk container having an outlet through which product is to be dispensed; a discharge device having an inlet end, an outlet end, and a wall extending between said inlet and said outlet end, wherein the discharge device defines a passageway or conduit for directing a flow of product from the bulk container, and the assembly includes an arrangement for moving the inlet end of the discharge device against the bulk container.

In exemplary embodiments, the assembly includes an arrangement for moving the inlet end relative to the outlet end, e.g. to raise the position of the inlet end relative to said outlet end.

In exemplary embodiments, the wall between said inlet end and said outlet end is of flexible construction, e.g. a flexible fabric material.

In exemplary embodiments, the device includes a support plate for supporting the lower end of a bulk container, and a vibration unit for vibrating said support plate. In exemplary embodiments, the outlet end of the discharge device comprises the support plate. In exemplary embodiments, the support plate is a flat plate having an aperture which defines an outlet region through which the outlet of a bulk container can extend when supported on the support plate.

Exemplary embodiments include a detector for detecting product flow, and an actuator for selectively actuating the vibration unit in response to a signal from the detector.

In exemplary embodiments, the discharge device is configured to move the inlet end from a retracted state to an extended state. Exemplary embodiments include one or more cylinders for driving the inlet end away from the outlet end.

In exemplary embodiments, the device is operable between a first state in which the inlet and outlet ends are arranged at a first spacing, and a second state in which the inlet and outlet ends are arranged at a second spacing, greater than said first spacing, and wherein the wall defines a cone in the second state.

In exemplary embodiments, the device includes a valve for communication with the outlet of a bulk container and operable between open and closed states for selectively discharging product from the bulk container. In exemplary embodiments, the valve is arranged beneath said outlet end, and the assembly is configured to permit relative movement between said outlet end and the valve.

Exemplary embodiments include a container wall arranged supporting an outer or side wall of a bulk container arranged in communication with the outlet end of the apparatus.

In exemplary embodiments, the assembly comprises a frame to which the upper end of a bulk container may be attached, wherein the assembly is configured for raising the upper end of the container relative to the outlet end of the device. In exemplary embodiments, the frame includes an upper part to which the upper end of a bulk container may be attached, a discharge part on which the outlet end is supported, and wherein the upper part is movable relative to the discharge part, for lifting the upper end of the bulk container away from the outlet end of the discharge device.

The discharge device may include any combination of the features of the discharge apparatus of the first aspect of the invention.

The discharge assembly of the third or fourth aspects may be a fixed hopper station, a fixed surge hopper or silo, or a transportable assembly (i.e. non-fixed).

A fifth aspect of the invention provides a method of dispensing product from a bulk container of the kind having a body for containing product and a channel or other outlet conduit having an opening through which product can be dispensed, the method comprising: providing a discharge device having an inlet end and an outlet end; positioning the lower end of the bulk container inside the inlet end of the device, arranging the outlet conduit of the bulk container to extend through said outlet end of the discharge device; connecting a valve to the outlet conduit to selectively permit product to be discharge from the bulk container; and moving the inlet end of the discharge device relative to the outlet end during discharge of product from the bulk container.

In exemplary embodiments, the inlet end is moved against the body of the bulk container.

In exemplary embodiments, the discharge device forms part of a discharge apparatus in accordance with the first aspect of the invention.

A sixth aspect of the invention provides a method of dispensing product from a bulk container of the kind having a body for containing product and a channel or other outlet conduit having an opening through which product can be dispensed, the method comprising: providing a discharge device having a support plate with an outlet aperture, and a vibration unit for vibrating the support plate; positioning a lower end of the bulk container on the support plate; arranging the outlet conduit of the bulk container to extend through the outlet aperture of said support plate; connecting a valve to the outlet conduit; opening the valve to permit product to discharge from the bulk container; and selectively vibrating said support plate to promote flow of product from the container.

In exemplary embodiments, the discharge device forms part of a discharge apparatus in accordance with the second aspect of the invention.

DESCRIPTION OF DRAWINGS

Embodiment(s) of the invention will now be described with reference to the accompanying drawings of which.

DETAILED DESCRIPTION

Figure 1:
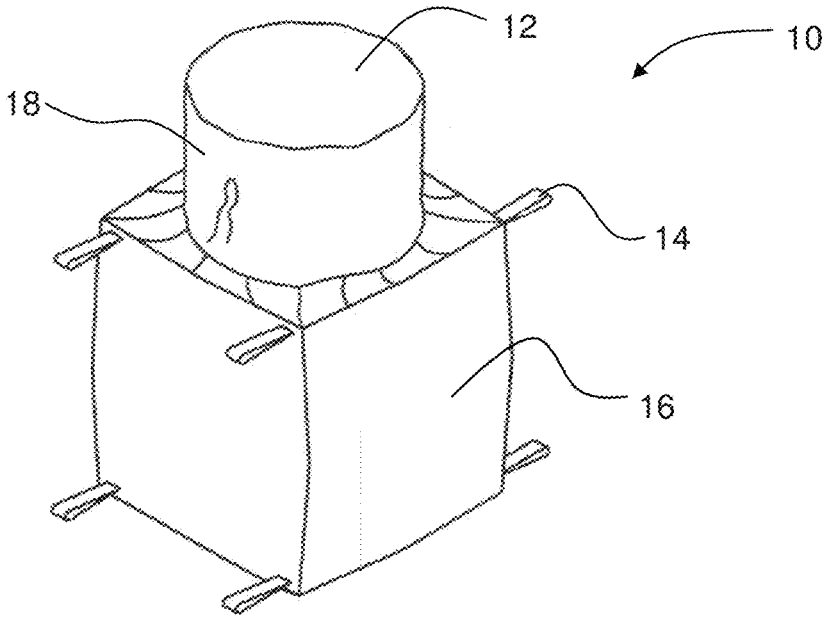
FIG. 1 shows a perspective view of a flexible intermediate bulk container.
Figure 2:
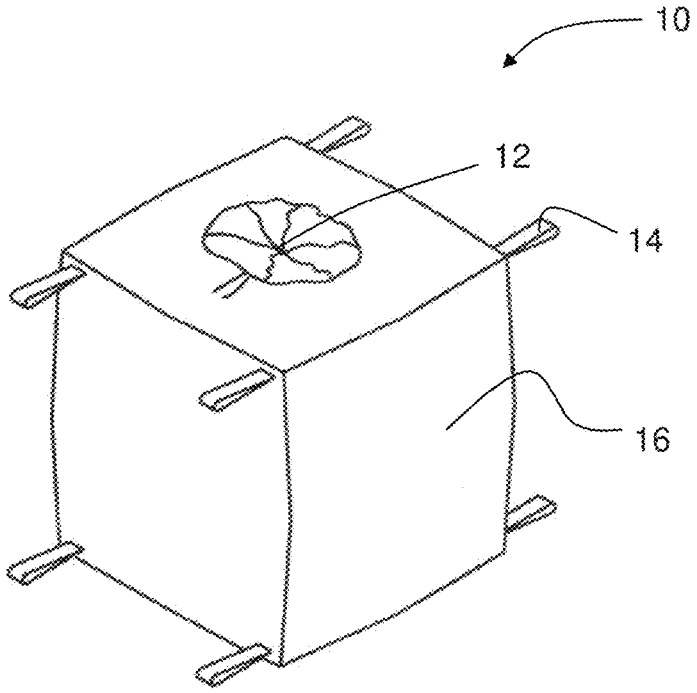
FIG. 2 is a perspective view of the bulk container of FIG. 1.
Figure 3:
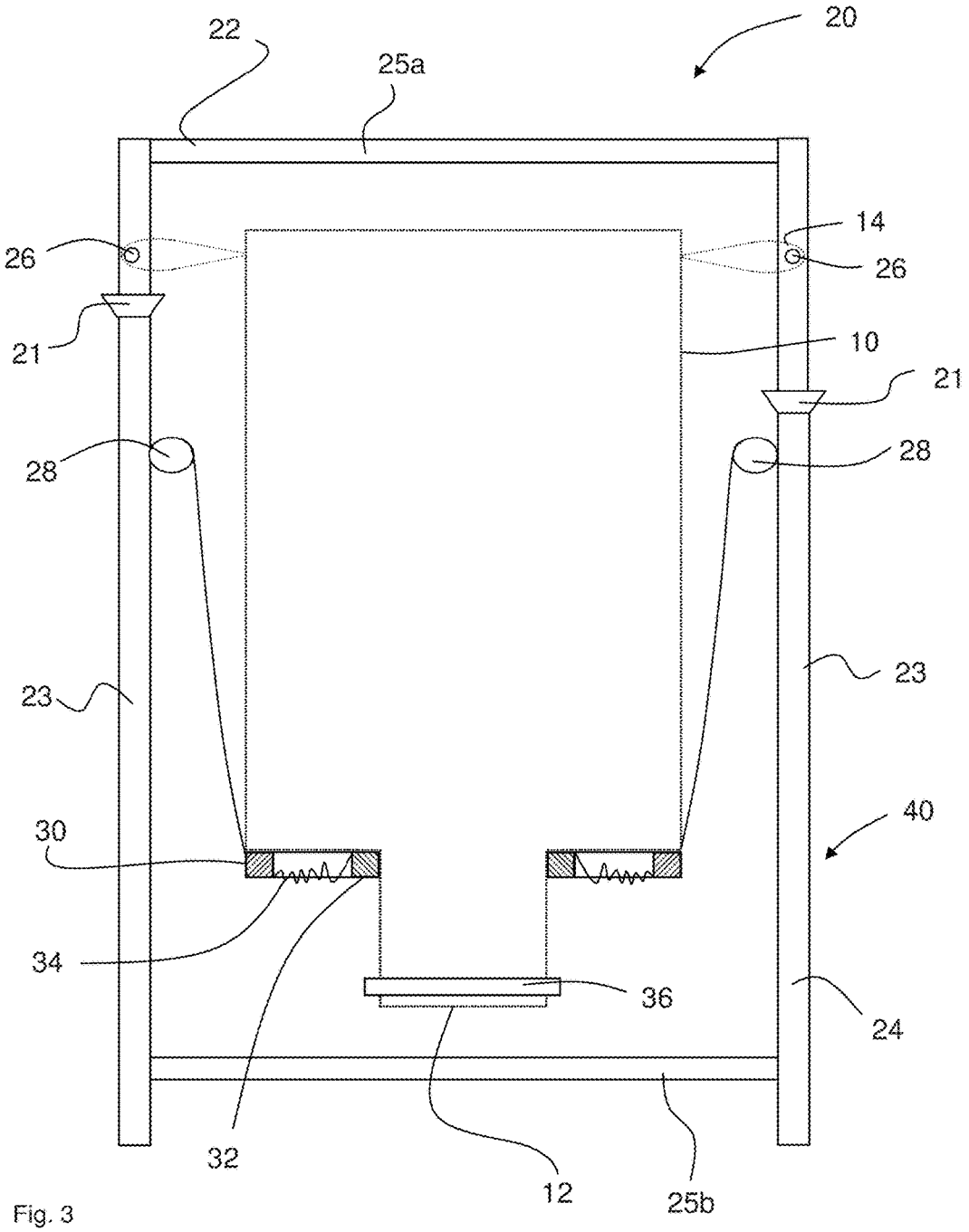
FIG. 3 is a schematic side view of a discharge assembly incorporating a discharge apparatus in accordance with an exemplary embodiment of the invention (shown in section)
Figure 4:
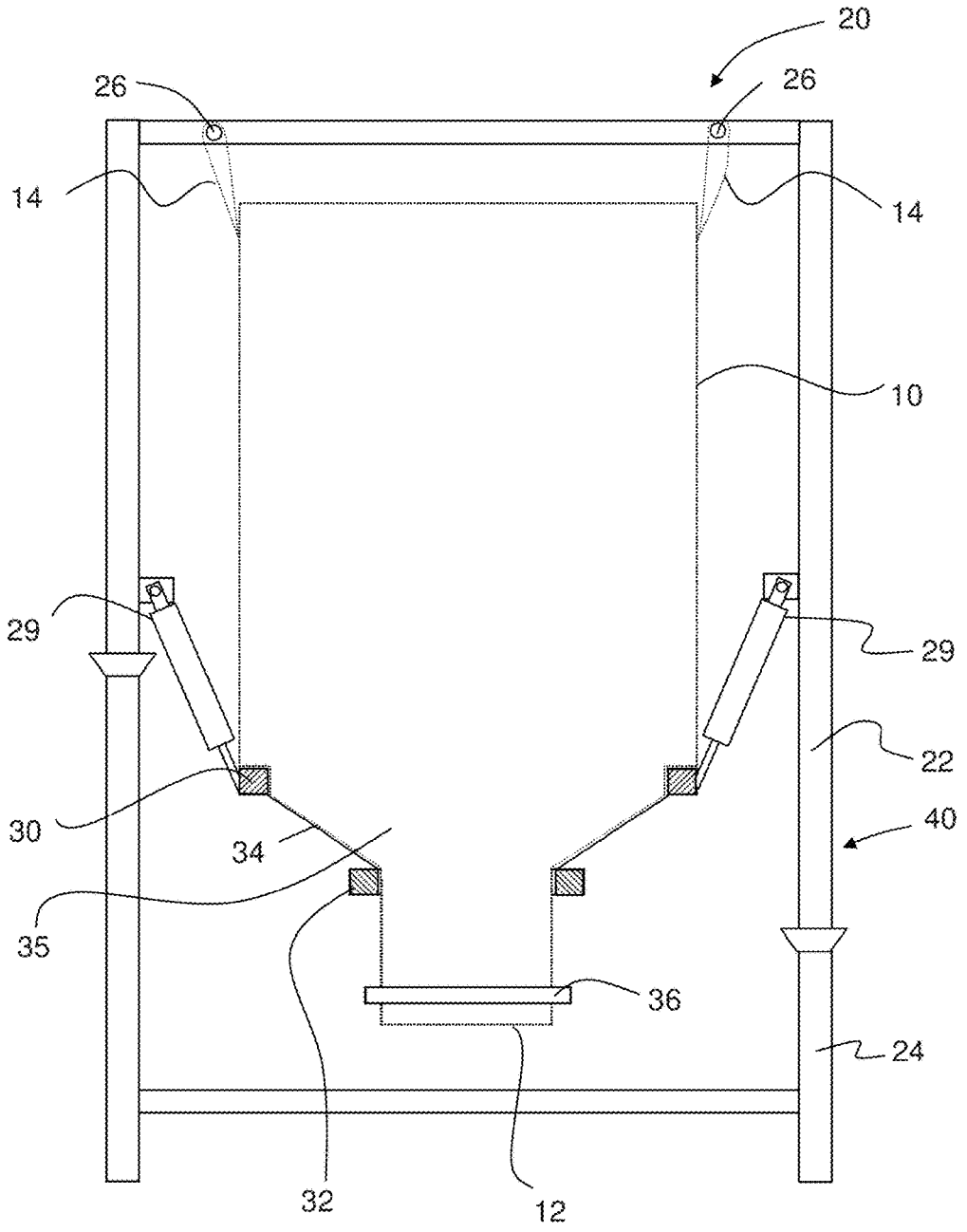
FIG. 4 is a schematic side view of the assembly of FIG. 3.
Figure 5:
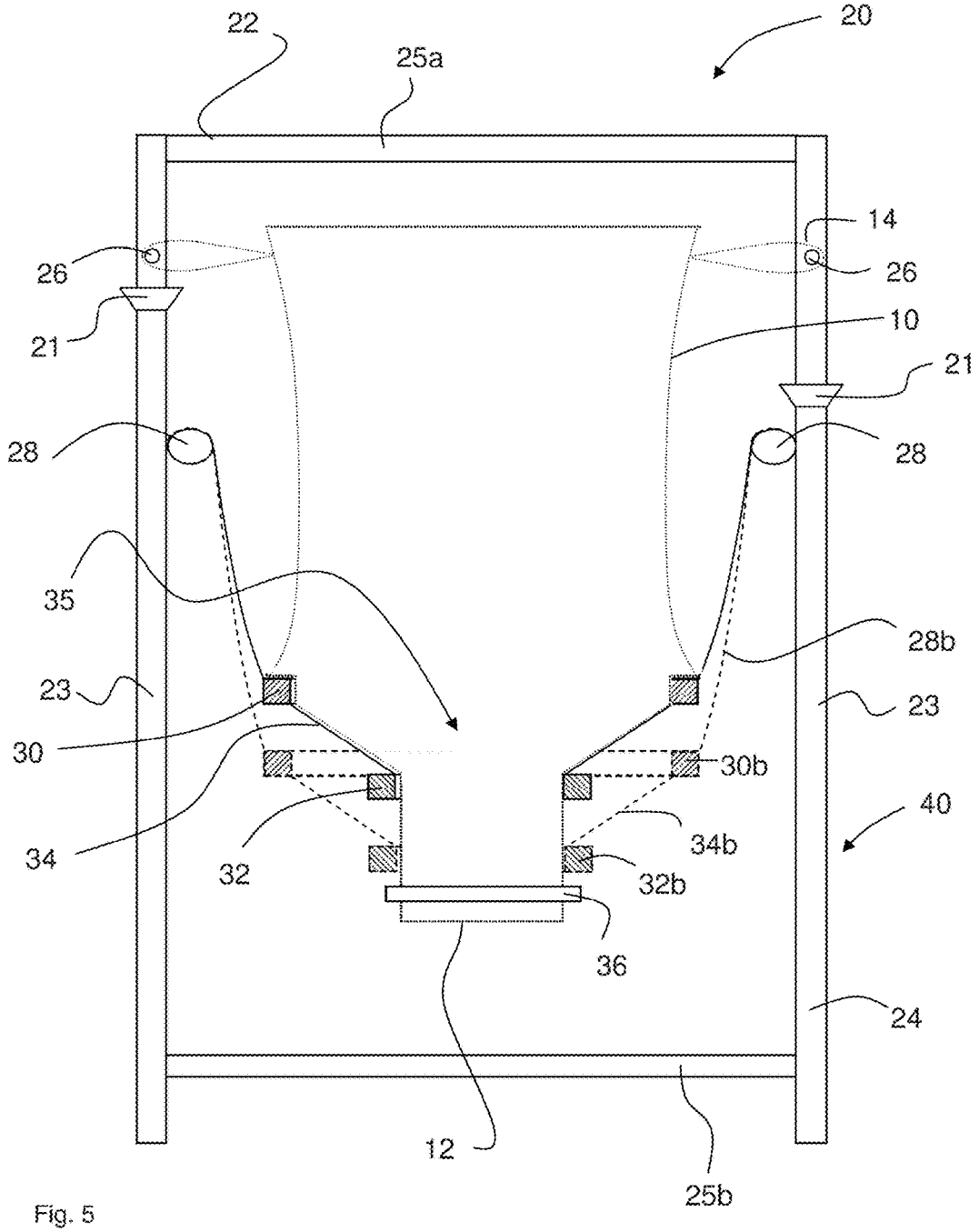
FIG. 5 is a further schematic side view of the assembly of FIG. 3.

Referring firstly to FIGS. 3 to 5, a discharge assembly is indicated generally at 20.

A bulk container (in particular, a flexible intermediate bulk container 10) is supported for a discharge operation on a rectangular frame. Although not visible in the drawings, the frame is square in plan view, having four legs 23 at corner regions of the frame, and cross bars 25*a*, 25*b* extending between the legs 23 at the upper and lower ends of the frame.

In this embodiment, the frame is formed in two parts: an upper or suspension part 22 and a lower or discharge part 24. The suspension part 22 seats on the discharge part at connectors 21. The connectors 21 may be offset from one another, to ensure correct positioning of the suspension part 22 on the discharge part 24.

A discharge device 40 is provided for controlled discharge of product from the container 10. The discharge device 40 is of variable configuration. More particularly, the discharge device 40 has an inlet part 30 and an outlet part 32, and the inlet part 30 is movable relative to the outlet part 32.

The inlet part 30 and outlet part 32 define concentric annuli (e.g. of circular or any other polygonal shape). In alternative embodiments, the outer perimeter of the inlet part 30 and/or outlet part 32 may be a different shape to the aperture defined by the annulus. For example, the outer perimeter of the inlet part 30 and/or outlet part 32 may be square or rectangular and the aperture may be circular. In this embodiment, the inlet and outlet parts 30, 32 are circular and each define a circular aperture.

A wall 34 extends between the inlet part 30 and the outlet part 32. In this example the wall is a flexible wall. The inlet part 30, the outlet part 32, and the wall 34 define a passageway 35 for directing a flow of product from the FIBC 10.

A biasing element 28 is connected to each leg 23 of the frame, such that there are four biasing elements in this embodiment (only two of which are shown in the Figures). In this embodiment, the biasing elements 28 are roller springs arranged to pull on the inlet part 30 of the discharge device 40, for urging the inlet part 30 in an upward direction. Hence, the inlet part 30 of the discharge device 40 is biased towards an extended state in which the inlet part 30 is spaced above the outlet part 32.

In alternative embodiments, other suitable biasing elements may be used. For example, a hydraulic, pneumatic or sprung cylinder arrangement may be used (as indicated at 29 in FIG. 4).

A hook or other connection point 26 is provided on the legs 23 of the suspension part 22 of the frame, for connection of the container 10, e.g. via loops 14 provided at the upper end of the container 10. In some embodiments, multiple hooks or connection points 26 may be positioned on each leg 23, so as to provide a variety of positions for connection of the container 10. Alternatively or in addition, one or more hooks or connection points 26 may be provided on the cross bar 25*a* of the suspension part 22 of the frame.

Typically, a forklift will be used to position the suspension part 22 over the upper end of a container 10 of product, the container will be connected to the suspension part and then carried by the suspension part 22 for positioning on the discharge part 24 of the frame.

The container 10 includes an outlet conduit 18 having an opening 12 through which product may be discharged from the container 10. The discharge device 40 includes a valve 36 (beneath the outlet part 32) to which the outlet conduit can be connected, e.g. in a dust-tight manner, for controlling the discharge of product from the container 10. In use, the outlet conduit 18 is arranged to extend through the inlet and outlet parts 30, 32 of the discharge device 40 for connection to the valve 36.

When a loaded container 10 is first arranged on the frame in the manner illustrated, the lower end of the container 10 is supported on the discharge device 40. Dependent on the weight of product in the container 10, the discharge device 40 will assume a collapsed state, e.g. as shown in FIG. 3, in which the flexible wall 34 of the discharge device 40 is in a collapsed or folded configuration, and the inlet part 30 is arranged at a reduced spacing or level with the outlet part 32 against the action of the biasing elements 28.

When the valve 36 is opened, product may begin to discharge from the container 10. This reduces the weight of product acting on the discharge device 40. Gradually, as more product is discharged and the weight is further reduced, the biasing elements 28 act to pull the inlet part 30 of the discharge device 40 in an upward direction away from the outlet part 32, driving the inlet part against the container 10. Hence, the spacing between the inlet end 30 and the outlet end 32 increases, causing the flexible wall 34 to become progressively unfolded until the discharge device 40 reaches a fully extended state, e.g. as shown in FIG. 4. In this embodiment, the discharge device 40 defines a cone-shaped passageway 35 between the inlet and outlet parts 30, 32 in the extended state.

This movement of the discharge device 40 from a collapsed state to an extended state has been found to improve the discharge of product from the FIBC, particularly for consolidated product.

During discharge, the outlet end 32 of the discharge device 40 remains generally stationary, at least until the discharge device 40 assumes a fully extended state. However, in exemplary embodiments, the discharge device 40 is configured to enable the outlet part 32 to move upwards away from the valve 36, under the action of the biasing elements 28 when the discharge device 40 has reached its fully extended state (e.g. with the flexible wall 34 under tension). In effect, the biasing elements 28 serve to pull the inlet and outlet ends upwards relative to the valve 36 (e.g. as shown in FIG. 5). This movement will extend and/or agitate the outlet conduit 18 of the container 10, so as to discharge any product that may be held within any creases in the conduit 18 etc.

When the discharge assembly 20 is used on a production line, it may be desirable to have multiple discharge assemblies in storage, e.g. with a container 10 attached to an associated discharge device 40. When a replacement container 10 is required, the whole discharge assembly 20 can be moved to a discharge site. For example, the whole discharge assembly 20 may be fork lifted to and located at the required discharge point. Alternatively, the whole discharge assembly 20 may be brought on stream automatically.

Alternatively, the discharge assembly 20 may be a fixed discharge station. In such an embodiment, the bulk container 10 can be loaded, for example by fork truck or hoist, onto the frame 22, 24. Once discharged, the bulk container 10 can be removed from the frame 22, 24.

Advantageously, the configuration of the discharge assembly 20 is such that the head room required for the discharge assembly is fixed, i.e. it is defined by the frame parts 22, 24. The movement of the inlet end 30 and/or outlet end 32 within the volume defined by the frame improves discharge efficiency without the need to increase the head height.

The movement of the inlet part 30 away from the outlet part 32 permits the discharge device to form a passageway to direct flow of product from the container whilst also agitating the product in the container, thereby improving the flow of product from the container. Furthermore, subsequent movement of the outlet part away from the valve 36 means that the contents of the container are further agitated, and any product caught within any creases in the outlet conduit 18 can be displaced. Thus, discharge assemblies of the type described herein enable improved discharge efficiency. This is particularly important when the product contained in the FIBC is expensive, and/or when operative time needs to be minimised (e.g. with little or no manual intervention).

A further embodiment of a discharge assembly 120 is shown in FIGS. 6 to 9. Features similar to the features of the embodiment shown in FIGS. 1 to 5 are given similar reference numerals but with a pre-fix of "1".

As with the previous embodiments, the discharge assembly 120 includes a discharge device 140 having first and second parts 130, 132 with a flexible wall 134 connected therebetween, wherein the first part 130 is movable (upwards) away from the second part 132, to transfer the wall 134 from a collapsed state to and extended state in which the device 140 defines a cone.

In this embodiment, the first part 130 defines a ring having an internal diameter which is generally greater than the diameter of the container intended for use with the device 140, e.g. an FIBC, so that the lower end of the container can pass through the ring and be supported by the cone when the device 140 in the extended state.

In the collapsed state, the first part 130 sits on an upper surface of the second part 132. The second part 132 takes the form of a flat support plate. In this embodiment, the support plate 132 is round and is dimensioned to correspond at least to the dimensions of the base of the FIBC 10. The support plate 132 has a central aperture which in this embodiment is a circular hole of a size suitable to allow the outlet conduit of the container 110 to pass through e.g. for connection to a discharge valve.

A vibration unit 152 is mounted on an underside of the support plate 132 and is operable to vibrate the support plate 132.

The discharge assembly 120 includes a transfer section or conduit 154 extending between an outlet of the discharge device 140 and a lower region of the discharge assembly 120, for transferring product discharged from the bulk container 110.

A detector 156 is provided in the conduit 154, for detecting the level of product within the collar, and therefore the effectiveness of the flow of product from the bulk container. The detector 156 in this embodiment is an optical detector, but in alternative embodiments the detector may be any suitable detector.

The conduit 154 communicates with a feeder 158 for communicating the discharged product to a desired location. The feeder 158 may also include a vibration unit for agitating the product within the feeder 158.

In this embodiment, cylinders 128 (e.g. hydraulic or pneumatic cylinders) are used to lift the first part 130 of the discharge device 140 away from the support plate 132. The cylinders 128 are housed in the legs 123 of the frame (which are of hollow box section). The cylinders 128 include a piston which moves in a vertical direction, in order to raise the first part 130 of the discharge device 140. Each piston includes a wheeled runner which travels in contact with the inside of the leg 123 to ensure the cylinders stay nominally in line, and avoid jamming that might otherwise occur when lifting a variable or out of balance load.

In this embodiment, the upper frame 122 is configured to be movable in an upward direction, for lifting the upper end of the container during or after a discharge operation. In this embodiment this is achieved using cylinders (e.g. hydraulic or pneumatic), but any suitable means may be provided. The effect is to stretch the container from a loose, substantially empty state after movement of the discharge device to its extended state, and ensure that any trapped product is shaken out.

An additional vibration unit (not shown) may be provided on the inlet ring 130. For example, the inlet may be vibrated when the inlet is lifted, and/or after the inlet has been lifted, to cause the wall of the cone to vibrate the cone and promote product flow.

Use of the discharge assembly shown in FIGS. 6 to 9 will now be described. Of course in some embodiments, where appropriate, the following steps may be performed in an alternative order.

Figure 6:
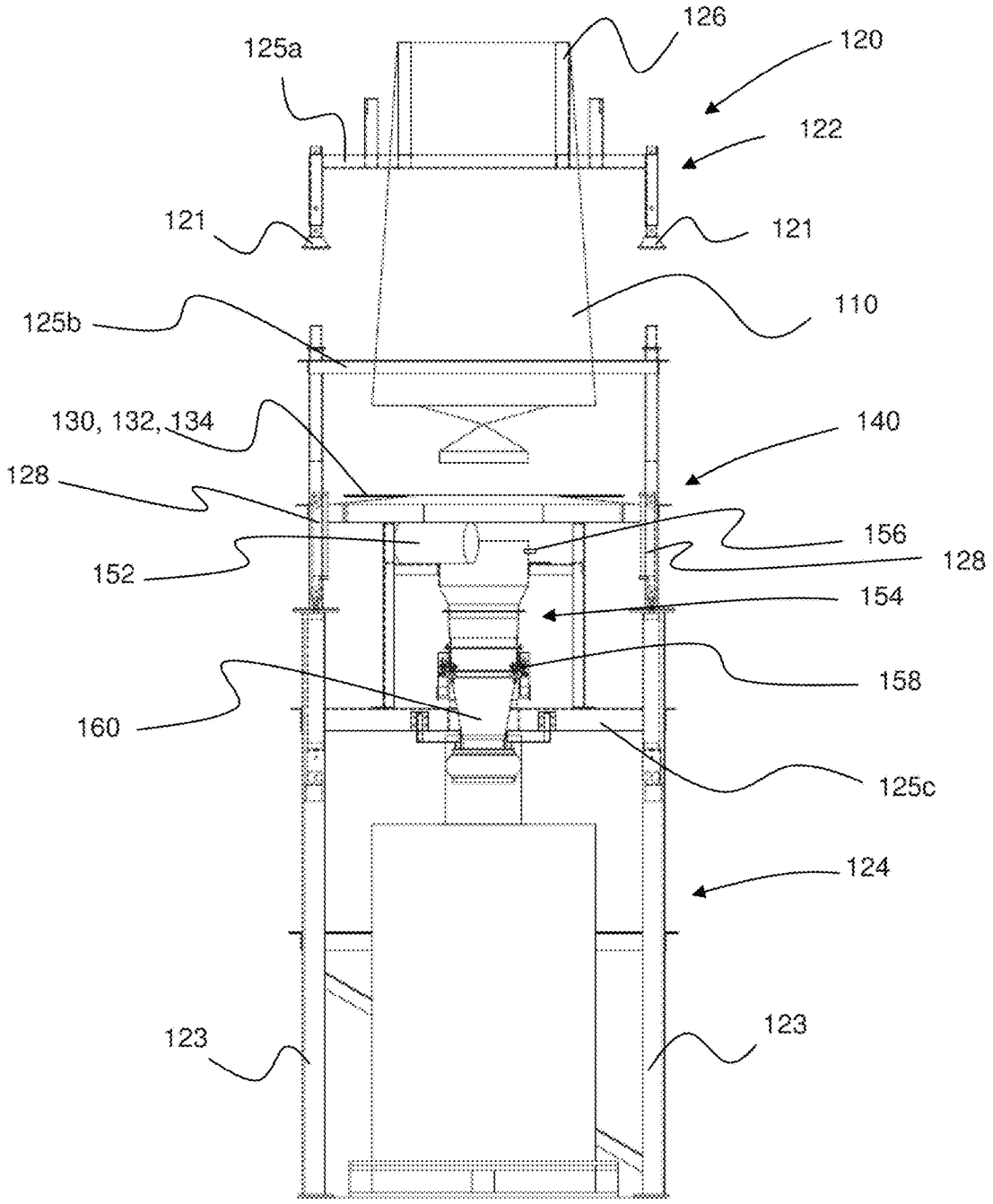
FIGS. 6 to 10 show a front view of a discharge assembly incorporating a discharge apparatus in accordance with a further exemplary embodiment of the invention, each figure illustrating a step in a method of using said discharge assembly.
Figure 7:
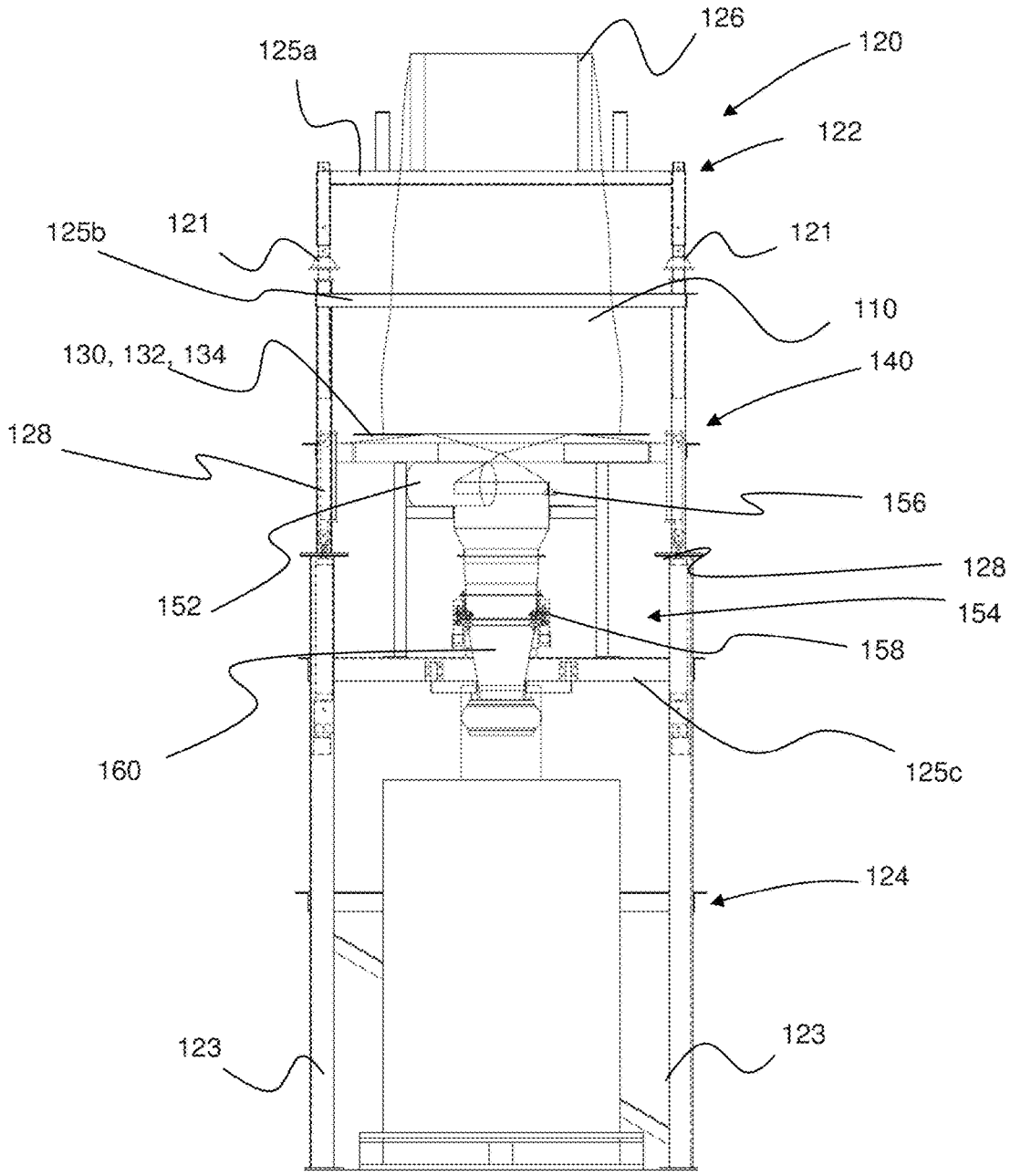

Referring to FIG. 6, the upper end of the FIBC 110 is connected to the suspension part 122 of the frame (e.g. via an attachment part 126 mounted on the cross beam 125*a*). The suspension part 122 is then lifted onto the discharge part 120, so that the lower end of the FIBC 110 is located within the ring 130, with the outlet conduit extending through the aperture in the support plate 132 (as shown in FIG. 7). The outlet conduit is then connected to the transfer section 154 in dust tight manner.

Figure 8:
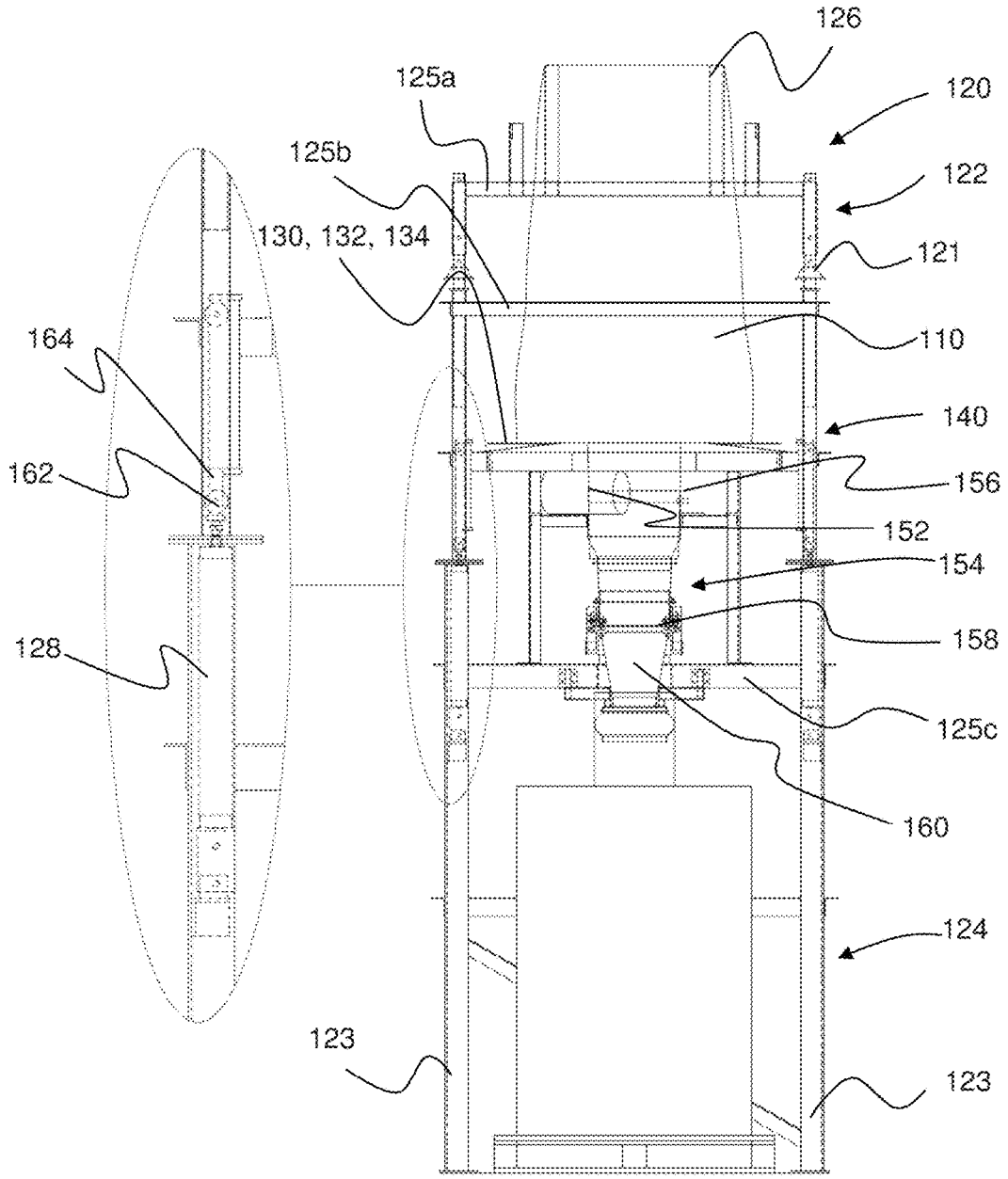

Referring to FIG. 8, the outlet conduit is then opened, for example by untying the end or opening a valve. Product is then released from the FIBC 110 into the transfer section 154 and to the feeder 158.

The lower end of the container 110 sits on the flat plate 132. The vibration unit 152 may be manually actuated. Vibration of the plate 132 undermines the product within the container and promotes flow through the outlet conduit. The vibration unit 152 can be activated intermittently or left running permanently, if desired or required. However, in exemplary embodiments, operation of the unit 152 is controlled automatically, in response to signals from the detector. In particular, if the detector recognises that the outlet conduit is full of product, the vibration unit is switched off or remains inactive. However, if the detector recognises that the outlet conduit is empty (i.e. indicative that the product within the container has ceased to flow), the vibration unit is activated. This may be continuous activation until the detector recognises that the conduit is full again, or for a set time period, e.g. 30 seconds.

Figure 9:
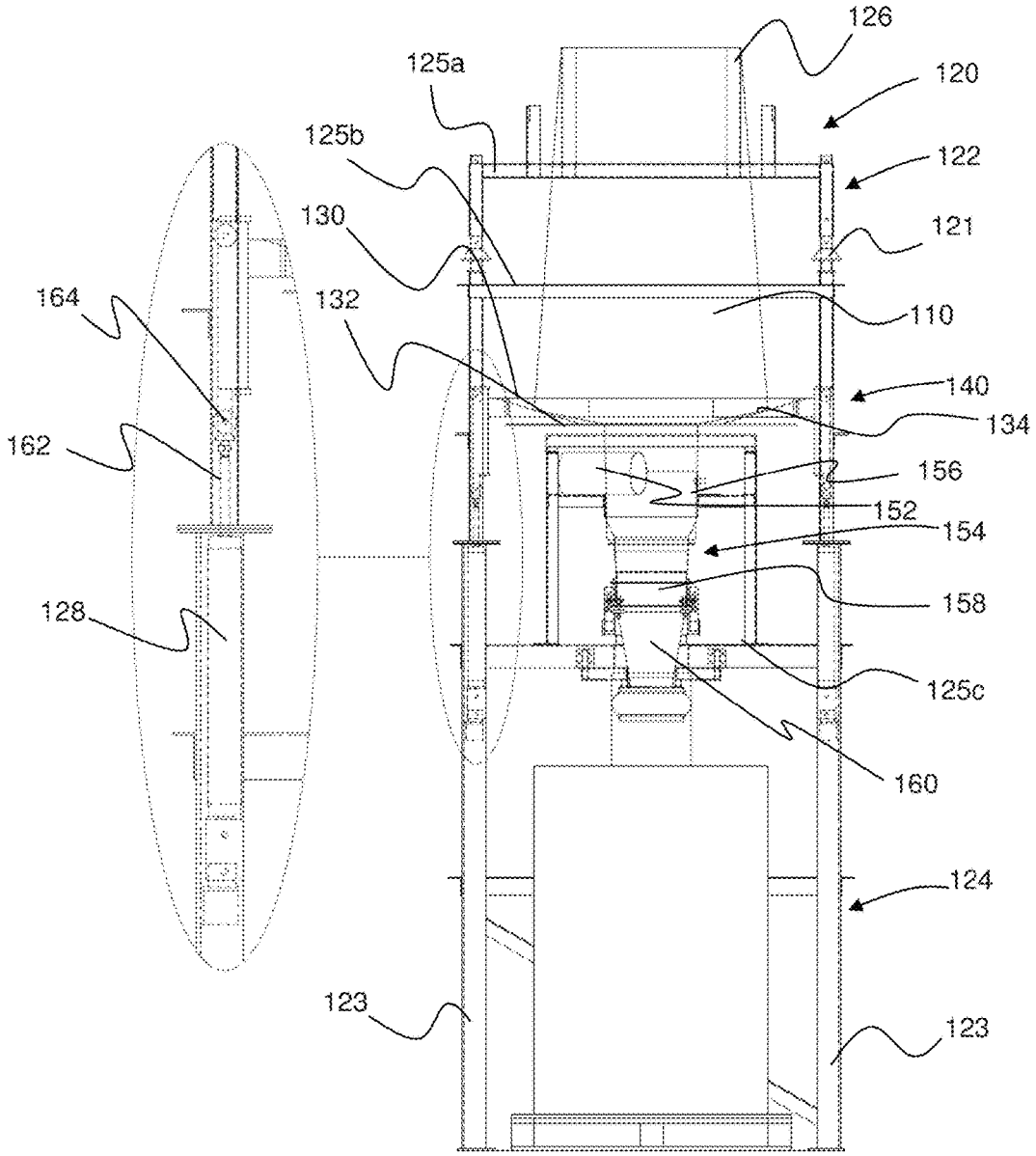

Referring to FIG. 9, as the product is released from the FIBC, the cylinders 128 are used to lift the first part 130 of the discharge device 140 upwardly away from the plate 132. This may be a gradual movement (e.g. dependent upon a rate of change of weight on the plate), or a single step movement from collapsed position to the extended position. Movement of the first part 130 to the extended position creates the cone shape, and this serves to better direct product out of the container 110.

Figure 10:
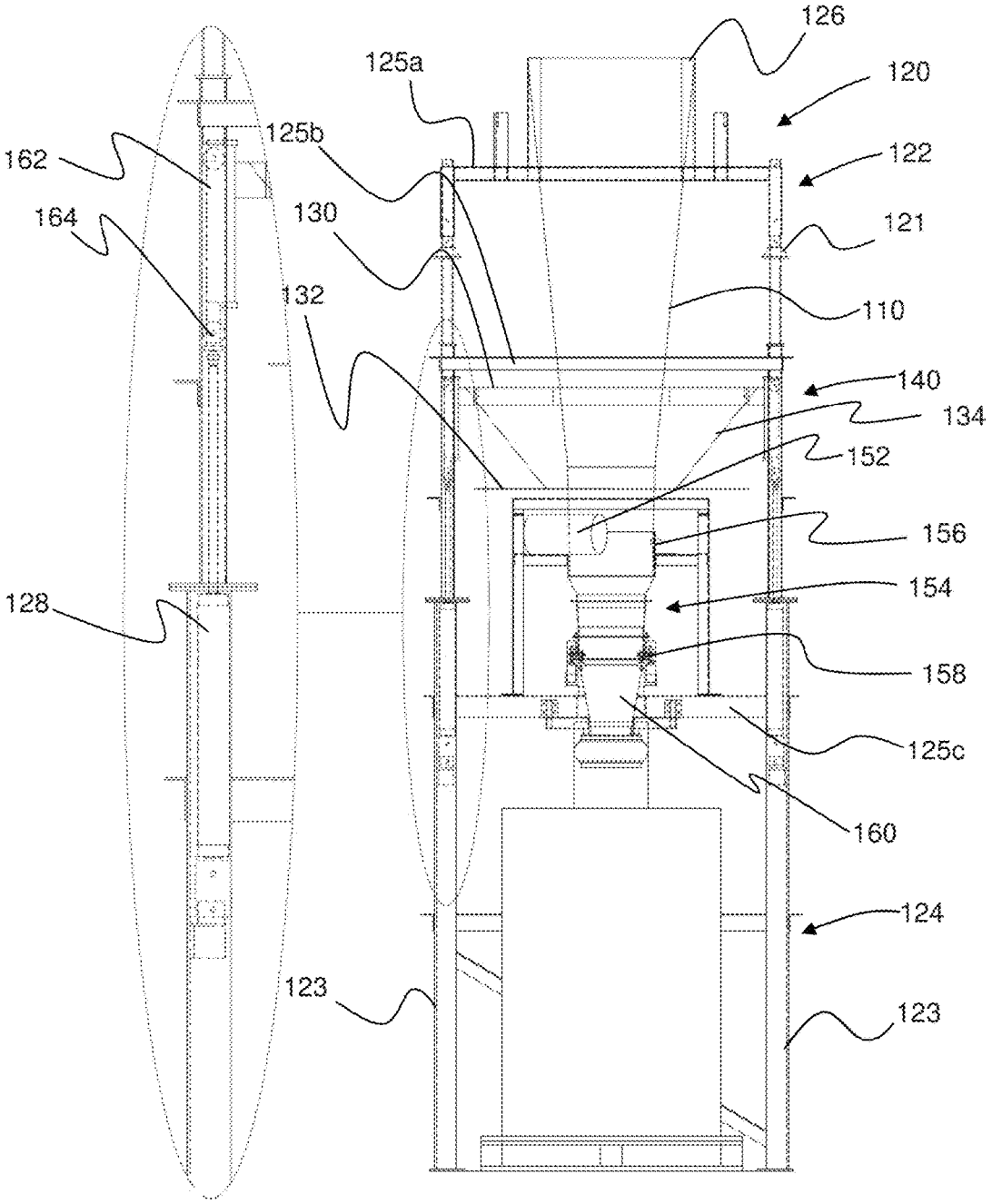
Figure 11:
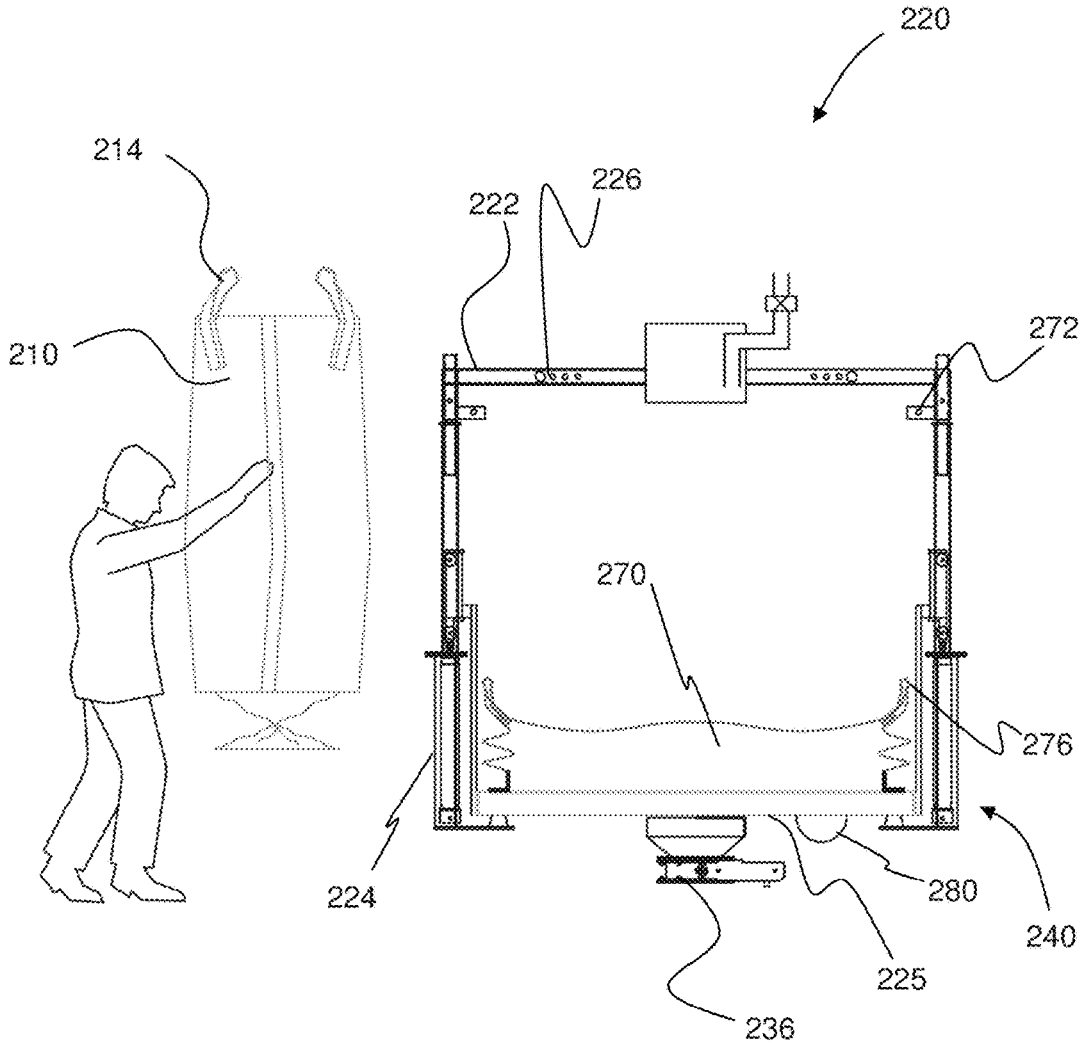
FIGS. 11 to 19 show a front view of a discharge assembly used as a fixed hopper, each figure illustrating a step in a method of using said discharge assembly.
Figure 12:
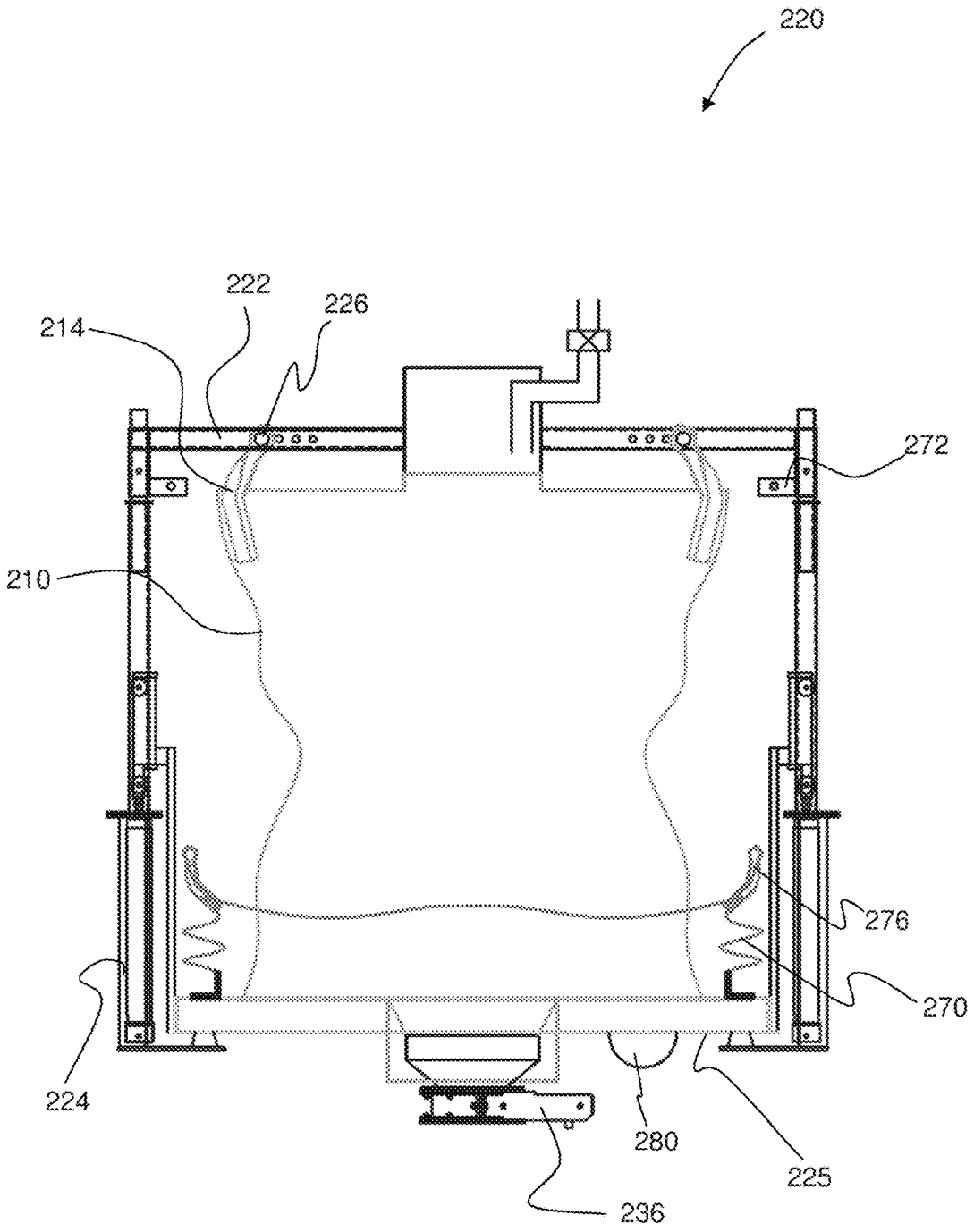

Referring to FIG. 10, once a large proportion of the contents of the FIBC have been emptied, the cylinders are used to lift the suspension part 122 of the frame. This in turn tensions the sides of the FIBC preventing product from resting in creases of the FIBC and further improving the discharge of product from the FIBC.

During the discharge process described above, if the detector indicates a low level of product discharge, the vibration unit 152 on the plate 132 to improve the discharge of product from the discharge device.

Although the invention has been described above with reference to one or more exemplary embodiments, it will be appreciated that various changes or modifications may be made without departing from the scope of the invention as defined in the appended claims.

For example, the FIBC may not be suspended from a frame, but may instead be suspended from a crane or other object, wherein the lower end of the FIBC is supported on the discharge device in such a way as to enable the discharge device to move from a collapsed state to an extended state during the discharge of product from the FIBC, with the upper end of the discharge device driven or otherwise urged upwards against the FIBC, e.g. under the influence of biasing elements 28.

In an exemplary embodiment, the biasing element, in particular a hydraulic or pneumatic cylinder, may be arranged to push against the load of the FIBC to push the inlet end of the discharge device upwards, rather than being arranged to pull the inlet upwards. Such an arrangement is particularly useful when the FIBC contains a low density product.

The above described discharge devices and discharge assemblies are suitable for use with 'big' bag such as an FIBC. The framework of the discharge assembly allows the FIBC to be fork-trucked to and located at the required discharge point. Alternatively, the frame could be brought on stream automatically or fetched from a remote location.

Trials have shown that it is possible for the FIBC to be loaded by fork-truck or hoist onto the discharge device and removed once discharged. This can improve the cycle time of the product discharge process, as well as increase productivity in the number of FIBC's capable of being handled at any one time.

The concepts described above are equally applicable to fixed discharge stations, including for smaller discharge applications from a container of any size and product (e.g. using bulk containers smaller than conventional FIBCs).

For example, the above described embodiments can be scaled down or modified for use as a small fixed station, to replace existing systems such as the "Pack Off Weigh Module", which will be familiar to a person skilled in the art. The embodiment shown in FIGS. 6 to 10 offers the benefit of an in-built flat bed vibration plate and flexible cone, making it very suitable for difficult powders during the packing off phase.

The invention can improve discharge capabilities either where difficult powders are handled or where improved discharge performance is a pre-requisite. Further, the discharge device and discharge assembly lends itself to being adapted for critical process applications.

FIGS. 11 to 19 illustrate another embodiment of a discharge assembly, ideally suited for use as a 'fixed hopper' type discharge station.

Many features of the discharge assembly shown in FIGS. 11 to 15 are similar to the features shown in FIGS. 6 to 10 (and FIGS. 3 to 5), and as such similar reference numerals are used but with a prefix "2" instead of "1". Features of the discharge assembly 220 similar to the features previously described are not described here in detail.

A significant difference of this embodiment is the provision of a container wall 270, which defines a barrier around the sides of the bulk container 210, providing additional strength and security. The container wall 270 is designed to contact the sides of the bulk container 210 when the bulk container is at full product capacity or fully inflated with air or any suitable gas such as nitrogen, such that the container wall 270 provides a support for the walls of the bulk container 210.

The container wall 270 is a flexible material that can be collapsed, e.g. during movement of the discharge device or alternatively can be lifted with the outlet and inlet part of the discharge device minimising wrinkling. In this embodiment, the bulk container 210 is a flexible intermediate bulk container (FIBC), and the container wall 270 is made from a similar flexible material as the FIBC (e.g. conventional FIBC fabric material).

The upper end of the container wall 270 is connected to the frame via loops 276 on the wall 270 and a hook or other type of fastener 272 on the frame, allowing for quick release of the container wall 270 from the frame. The quick release fastening and the flexible nature of the container allows for ease of access for when changing the bulk container, for example. The lower end of the container wall 270 is sealingly attached to the discharge device, to prevent egress of product in the event of a spillage from the bulk container 210.

FIGS. 11 to 19 show the stages of using the discharge assembly 220 as a fixed hopper station. Product flow is indicated by the dotted area 274. Firstly an empty FIBC 210 is carried by hand or preferably using a fork lift or hoist and positioned within a volume defined by the frame 222, 224 of the discharge device 240. Then, referring now to FIG. 12, the loops 214 of the FIBC 210 are hooked on to the connection point 226 of the suspension end 222 of the frame.

Figure 13:
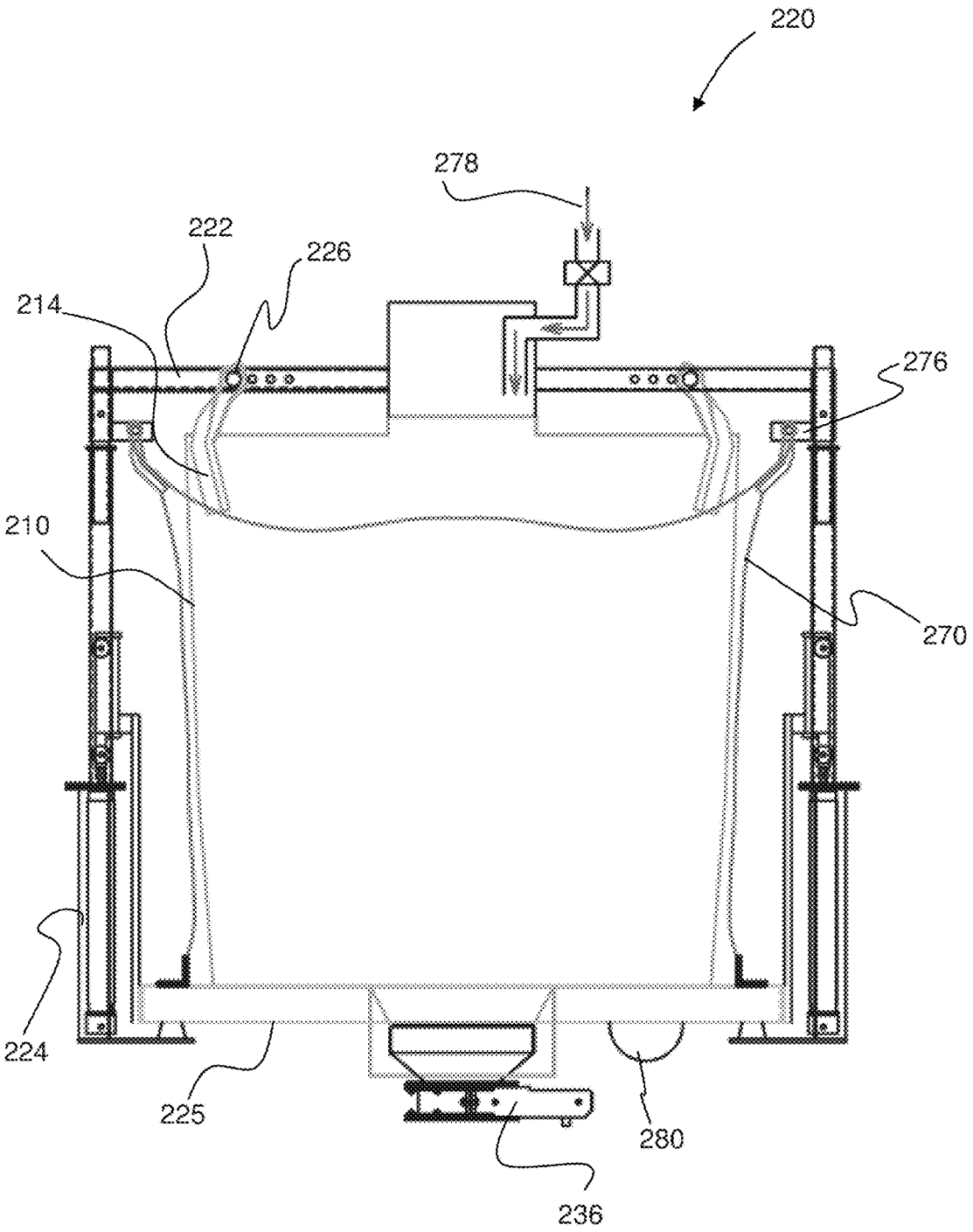

Referring to FIG. 13, the container wall 270 is then reconnected to the suspension end 222 of the frame so as to surround the sides of the FIBC 210. The FIBC 210 is then inflated using low pressure air or any suitable gas such as nitrogen (indicated by arrow 278) to shape the FIBC 210 to the full volume shape.

Figure 14:
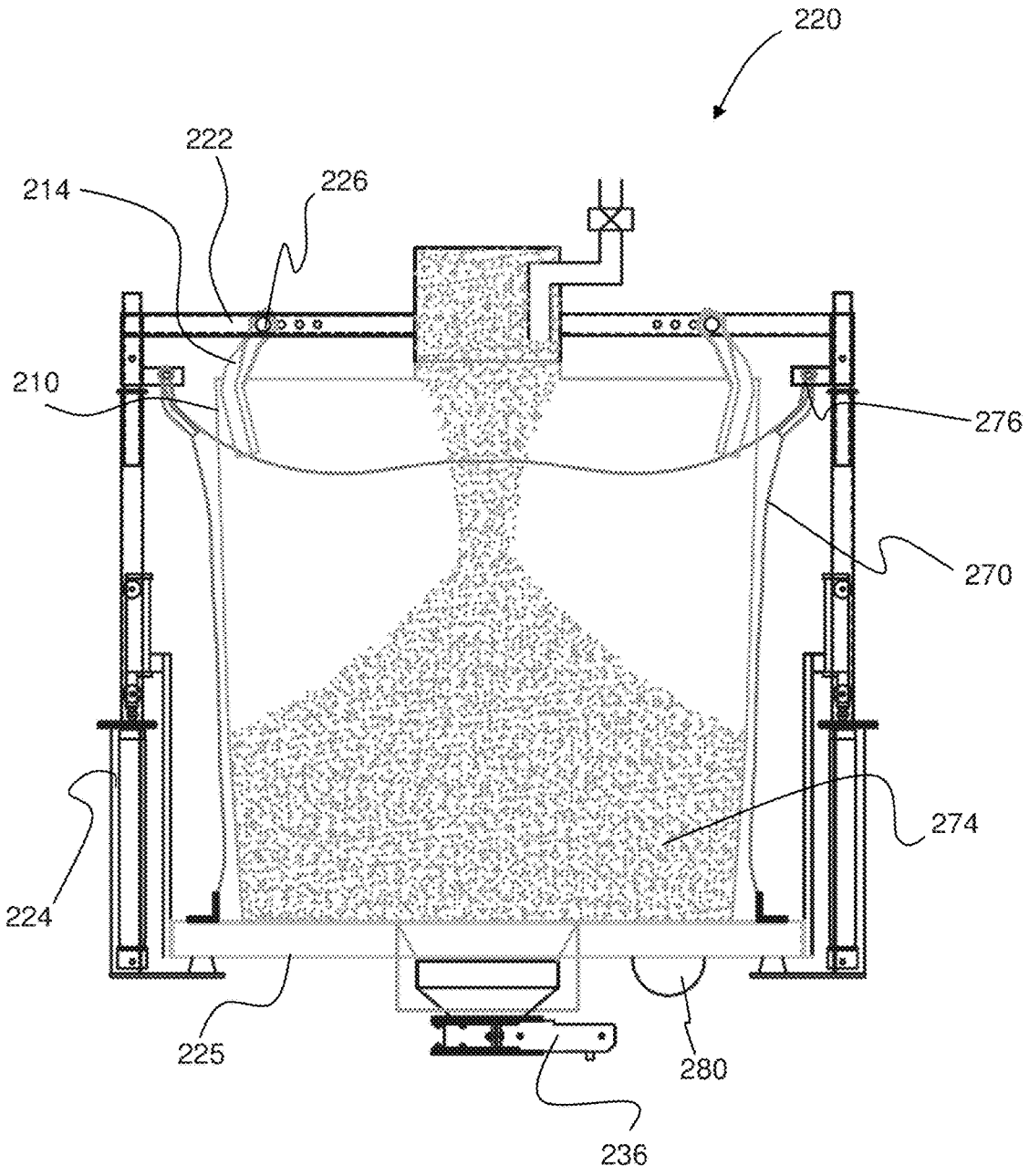

Referring now to FIG. 14, product 274 is introduced into the FIBC 210. The container wall 270 provides support for the walls of the FIBC 210 to prevent the FIBC 210 from bulging outwards and away from the desired shape.

Figure 15:
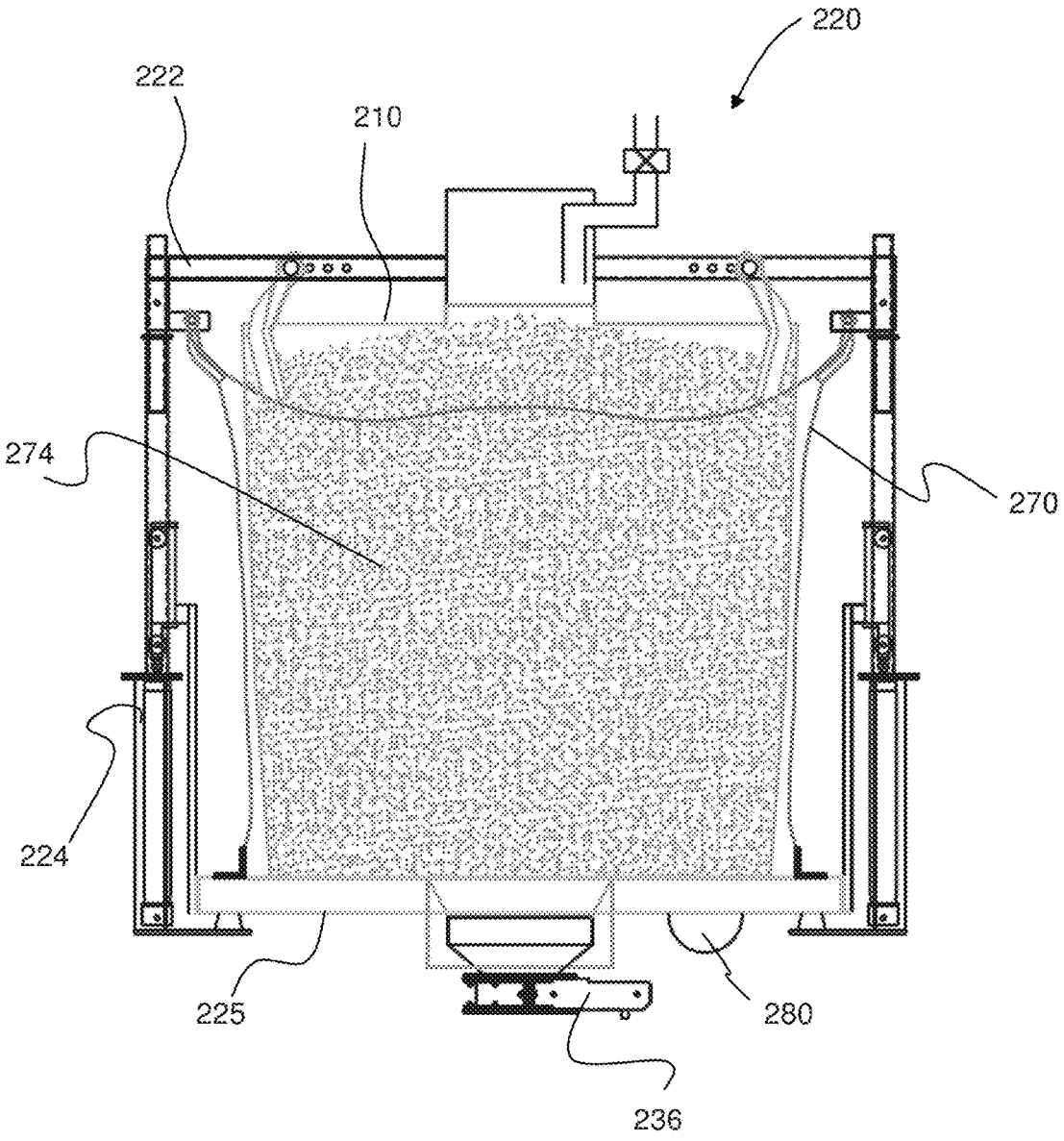
Figure 16:
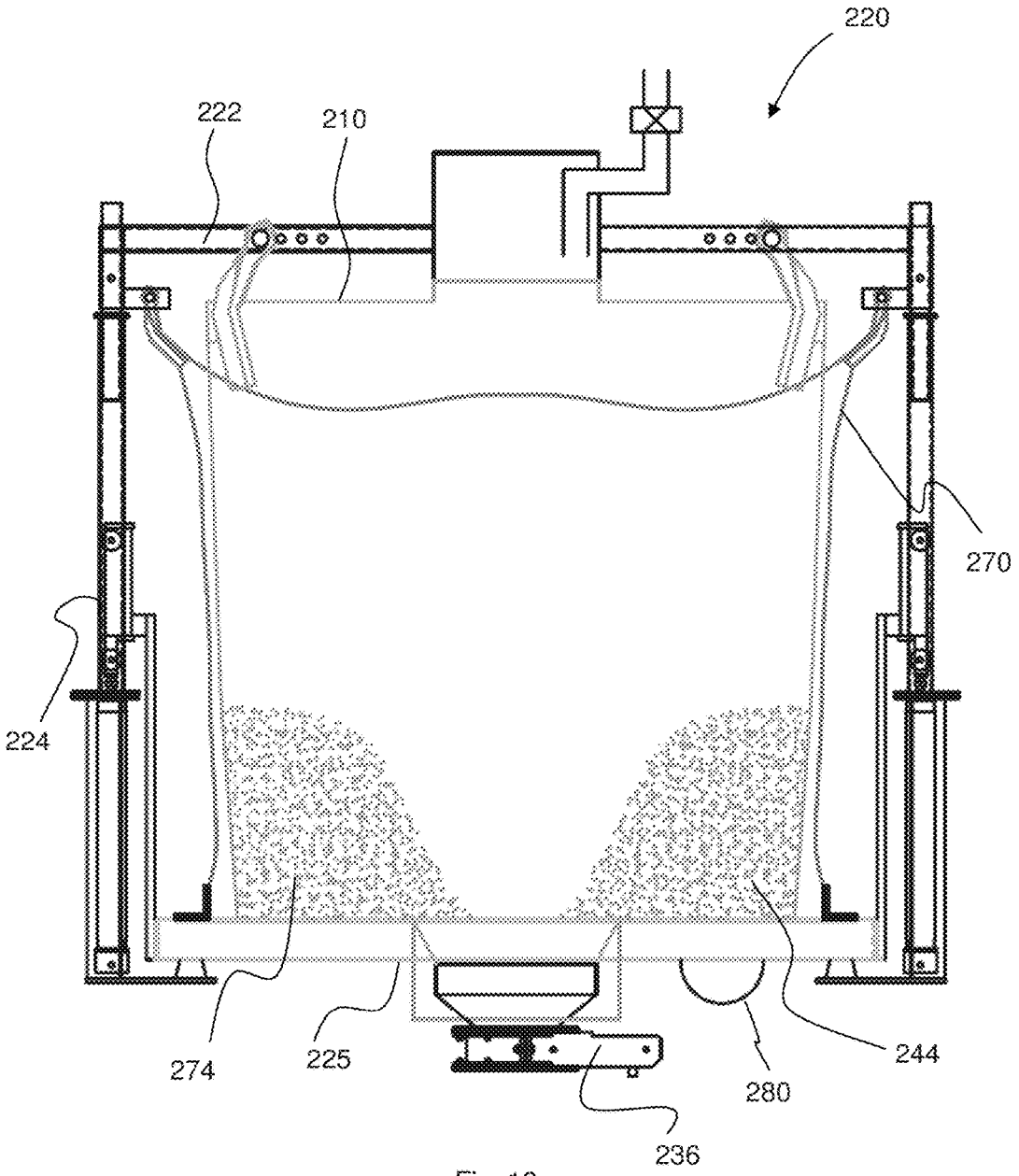

FIG. 15 shows the discharge assembly 220 when fully charged with product 274. The valve 236 may then be opened and product 274 discharged. FIG. 16 shows the discharge assembly 220 with the product 274 partially discharged.

Figure 17:
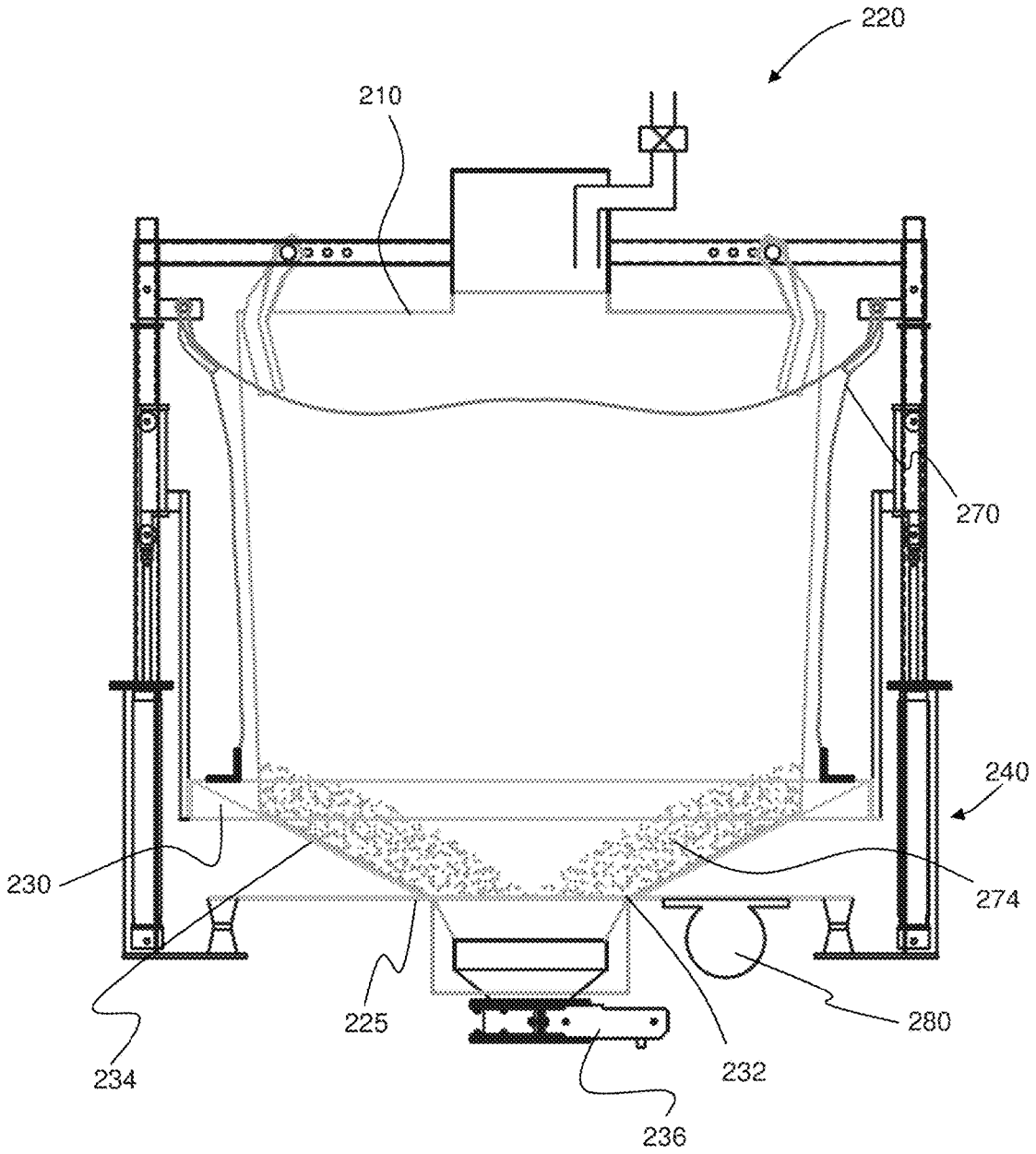
Figure 18:
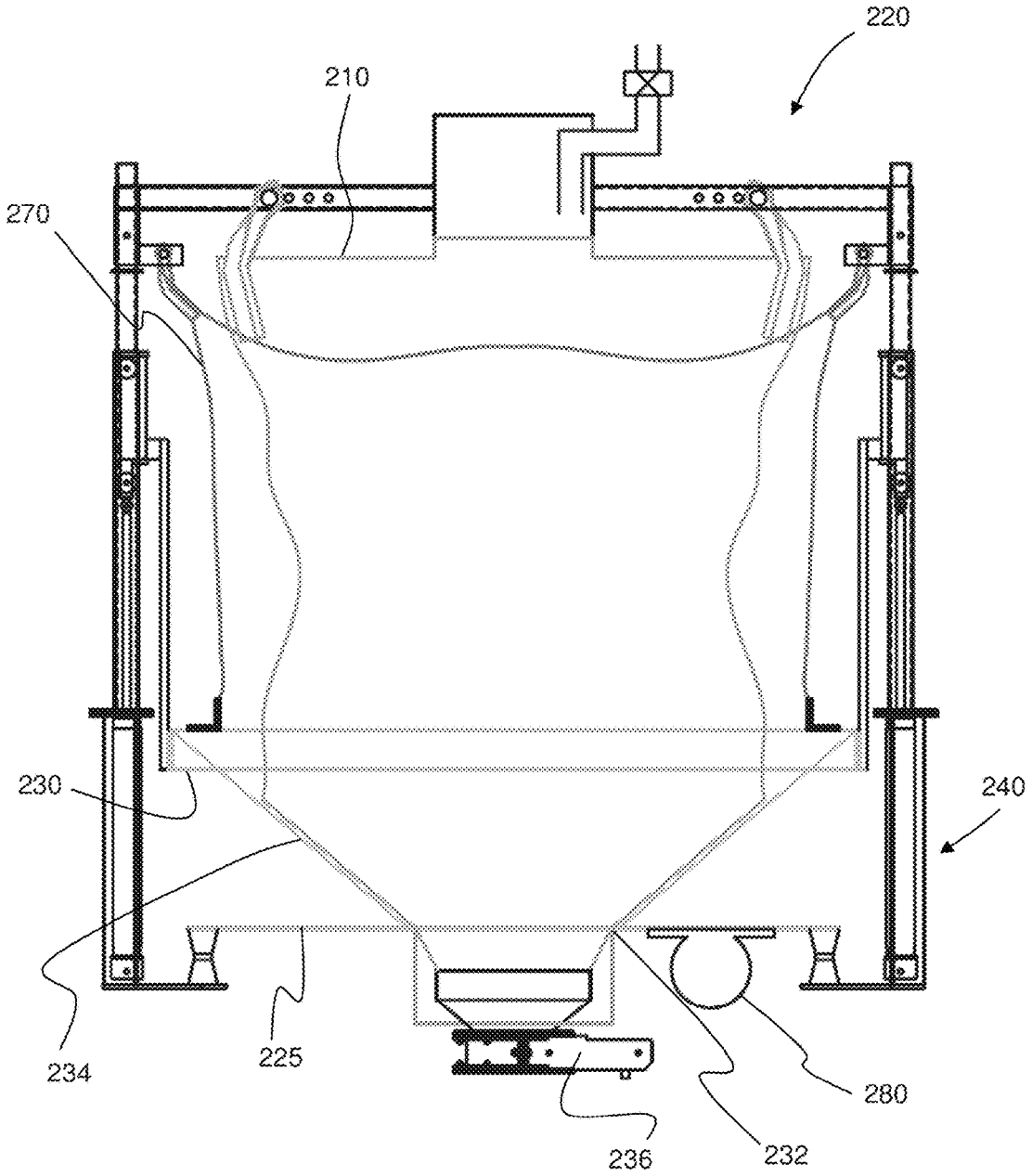
Figure 19:
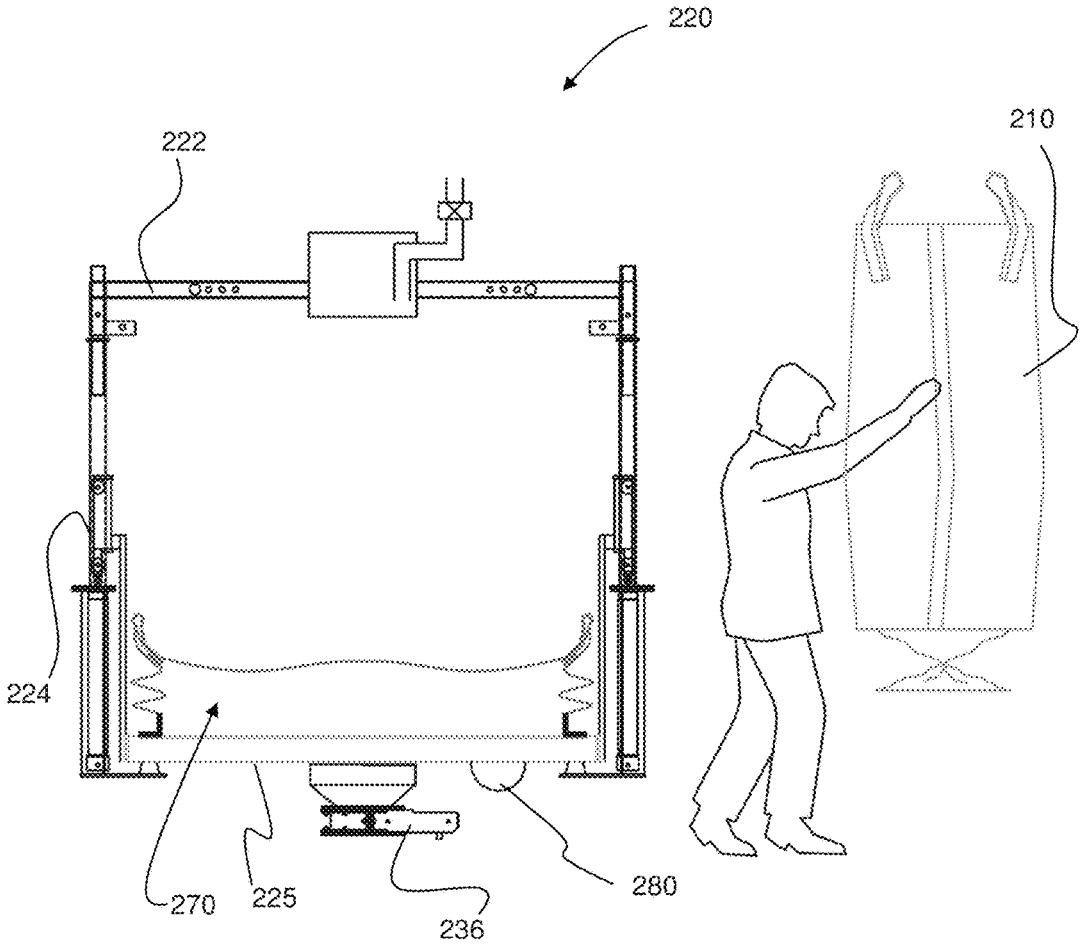

Referring to FIG. 17, the inlet part 230 of the discharge device 240 is then moved away from the outlet part 232 of the discharge device 240, such that the inlet part 230, outlet part 232, and the flexible wall 234 form a cone shape. Such movement improves the flow of product 274 out of the FIBC 210. The support plate 225 can be vibrated, using a vibration motor 280 connected to an underside of the support plate 225, as necessary to achieve improved discharge of product and permit the FIBC 210 to be fully or nearly fully emptied, as shown in FIG. 18.

It may be then desired that the FIBC 210 is refilled with product 274 for dispensing. In such cases, before the emptied FIBC 210 is refilled with product, the FIBC is inflated to its full volume shape.

When it is desired that the fixed hopper station be used for dispensing a different product, the FIBC 210 is removed from the discharge assembly 220 and a new FIBC is connected to the suspension end 222 of the frame in the manner previously described. To remove the FIBC 210 from the discharge assembly 220, the container wall 270 is released from the frame. The flexible nature of the container wall enables the wall to be pulled down towards the support plate 225 so as to expose the sides of the FIBC 210. The FIBC 210 can then be released from the suspension end 222 of the frame.

The embodiments described herein provide significant improvements over conventional discharge systems, such as quick release and replacement of a bulk container. In 'fixed hopper' applications, the discharge systems described herein avoid the need for hopper clean down in most circumstances, reducing the time for a product change and significantly reducing the risk of cross contamination.

The invention is further particularly beneficial when used as a fixed hopper as a result of the 'headroom' saving that can be achieved. Further, for those embodiments which incorporate a vibration unit as part of the discharge device, the vibration unit can operate to vibrate the support plate when the discharge valve is closed. Such operation can flatten the natural angle of (fill) repose of the product within the new container and therefore maximise the fill volume for a given headroom.

In a further embodiment the discharge device may be a site fixed surge hopper or small silo. In such applications the above described embodiments can be used to improve the discharge capabilities, particularly when difficult powders are handled or where improved discharge performance is a pre-requisite.

In any of the above described embodiments, when a new flexible intermediate bulk container 210 is introduced into the assembly 220, a flow of low pressure air may be introduced into the flexible bulk container 210 to shape the container to its full volume operational state.

The invention claimed is:

1. A discharge apparatus for use with a bulk container of the kind having an outlet through which product is to be dispensed, the discharge apparatus comprising:

an inlet end, an outlet end, and a wall extending between said inlet end and said outlet end, wherein said inlet end is configured for receiving the lower end of a bulk container, said outlet end is configured for directing a flow of product from the bulk container received in the inlet end, wherein the apparatus is configured to allow relative movement between said inlet end and said outlet end to alter the distance between said inlet end and said outlet end, wherein the wall between said inlet end and said outlet end is of flexible construction, to accommodate said relative movement, and wherein the apparatus is configured to be selectively positioned between a first state in which the inlet and outlet ends are arranged at a first spacing, and a second state in which the inlet and outlet ends are arranged at a second spacing, greater than said first spacing, and wherein the wall defines a cone in the second state.

2. The discharge apparatus according to claim 1, wherein the apparatus includes an arrangement for moving the inlet end away from the outlet end.

3. The discharge apparatus according to claim 2, wherein said arrangement is configured to raise the position of the inlet end relative to said outlet end.

4. The discharge assembly according to claim 3, comprising one or more cylinders for driving the inlet end away from the outlet end.

5. A discharge apparatus according to claim 4, wherein the apparatus includes a plurality of cylinders for lifting the inlet end relative to the outlet end, and the apparatus further includes a guide mechanism for guiding extension of the cylinders, so that the cylinders stay nominally in line during lifting movement of the inlet end.

6. The discharge apparatus according to claim 1, comprising a support plate for supporting the lower end of a bulk container, and a vibration unit for vibrating said support plate.

7. The discharge apparatus according to claim 6, wherein said outlet end comprises the support plate, and wherein the support plate is a flat plate having an aperture which defines an outlet region through which the outlet of a bulk container can extend when supported on the support plate.

8. The discharge apparatus according to claim 6, further comprising a detector for detecting product flow, and an actuator for selectively actuating the vibration unit in response to a signal from the detector.

9. The discharge apparatus according to claim 1, including a valve for communication with the outlet of a bulk container and operable between open and closed states for selectively discharging product from the bulk container.

10. The discharge apparatus according to claim 9, wherein the valve is arranged beneath said outlet end, and the apparatus is configured to permit relative movement between said outlet end and the valve.

11. The discharge apparatus according to claim 1, comprising a container wall arranged supporting an outer or side wall of a bulk container arranged in communication with the outlet end of the apparatus.

12. A discharge apparatus according to claim 1, comprising a frame to which the upper end of a bulk container may be attached, wherein the apparatus is configured for raising the upper end of the container relative to the outlet end of the discharge apparatus.

13. A discharge apparatus according to claim 12, wherein the frame includes an upper part to which the upper end of a bulk container may be attached, and a discharge part on which the outlet end is supported, wherein the upper part is movable relative to the discharge part, for lifting the upper end of the bulk container away from the outlet end of the discharge apparatus.

14. A discharge apparatus according to claim 13 wherein the apparatus includes cylinders for driving the upper part away from the discharge part.

15. A discharge device for use with a bulk container of the kind having an outlet through which product is to be dispensed, the discharge device comprising:

an inlet end and an outlet end and a wall extending between said inlet end and said outlet end, a support plate for supporting a bulk container, the support plate including an outlet region through which the outlet of a bulk container may extend when supported on the support plate; and a vibration unit for selectively vibrating said support plate, wherein the discharge device is configured to be selectively positioned between a first state in which the inlet and outlet ends are arranged at a first spacing, and a second state in which the inlet and outlet ends are arranged at a second spacing, greater than said first spacing, and wherein the wall defines a cone in the second state.

16. A discharge assembly comprising a discharge device in accordance with claim 15 and further comprising a frame for supporting the support plate and for supporting a bulk container in communication with the discharge device.

17. The discharge assembly according to claim 16 wherein the upper end of a bulk container may be attached to the frame, and the frame is configured for raising the upper end of the container relative to the support plate.

18. The discharge assembly according to claim 17 wherein the frame comprises two parts: an upper part for connection of the upper end of a bulk container and a discharge part which includes the discharge device, and wherein the upper part is movable relative to the discharge part, for lifting the upper end of the bulk container away from the support plate.

19. A discharge assembly comprising: a bulk container having an outlet through which product is to be dispensed; a discharge device having an inlet end and an outlet end and a wall extending between said inlet and said outlet end, wherein the discharge device defines a passageway or conduit for directing a flow of product from the bulk container, and the assembly includes an arrangement for moving the inlet end of the discharge device against the bulk container, wherein the discharge device is configured to be selectively positioned between a first state in which the inlet and outlet ends are arranged at a first spacing, and a second state in which the inlet and outlet ends are arranged at a second spacing, greater than said first spacing, and wherein the wall defines a cone in the second state.

* * * * *